US008644731B2

(12) United States Patent
Tanaka

(10) Patent No.: US 8,644,731 B2
(45) Date of Patent: Feb. 4, 2014

(54) CHARGING DEVICE AND IMAGE FORMING APPARATUS

(75) Inventor: Kuniaki Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 270 days.

(21) Appl. No.: 13/198,404

(22) Filed: Aug. 4, 2011

(65) Prior Publication Data

US 2012/0207513 A1 Aug. 16, 2012

(30) Foreign Application Priority Data

Feb. 16, 2011 (JP) ..... 2011-031052

(51) Int. Cl.
*G03G 21/18* (2006.01)

(52) U.S. Cl.
USPC ..... 399/115; 399/50; 399/100; 399/168

(58) Field of Classification Search
USPC ..... 399/50, 60, 115, 168
See application file for complete search history.

(56) References Cited

U.S. PATENT DOCUMENTS

| | | | | |
|---|---|---|---|---|
| 5,095,335 | A * | 3/1992 | Watanabe et al. | 399/111 |
| 8,050,590 | B2 * | 11/2011 | Parks | 399/100 |
| 2012/0207514 | A1 * | 8/2012 | Tanaka | 399/115 |

FOREIGN PATENT DOCUMENTS

| | | | |
|---|---|---|---|
| JP | 63-267973 | A | 11/1988 |
| JP | 08-062950 | A | 3/1996 |

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

A charging device includes a charger facing a rotatably supported image carrier and configured to charge the image carrier on which an electrostatic latent image is to be formed, and a movement mechanism configured to move the charger between a charging position at which the charger is close to the image carrier and a retracted position at which the charger is retracted away from the image carrier. The movement mechanism includes a support member supporting the charger that has been moved to the retracted position by the movement mechanism, and a movable member configured to move when a driving force from a drive source is transmitted thereto. The movable member moves to the charging position or the retracted position when the movable member is moved in a direction of a rotational axis of the image carrier while being in contact with the support member.

18 Claims, 30 Drawing Sheets

CHARGING DEVICE AND IMAGE FORMING APPARATUS

CROSS-REFERENCE TO RELATED APPLICATIONS

This application is based on and claims priority under 35 USC 119 from Japanese Patent Application No. 2011-031052 filed Feb. 16, 2011.

BACKGROUND

Technical Field

The present invention relates to a charging device and an image forming apparatus.

SUMMARY

According to a first aspect of the invention, there is provided a charging device including a charger facing a rotatably supported image carrier, the charger being configured to charge a surface of the image carrier on which an electrostatic latent image is to be formed; and a movement mechanism configured to move the charger between a charging position at which the charger is close to the surface of the image carrier and a retracted position at which the charger is retracted away from the surface of the image carrier. The movement mechanism includes a support member supporting the charger that has been moved to the retracted position by the movement mechanism, and a movable member configured to move when a driving force from a drive source is transmitted thereto. The support member and the movable member are configured such that the movable member moves to the charging position or the retracted position when the movable member is moved in a direction of a rotational axis of the image carrier while being in contact with the support member.

BRIEF DESCRIPTION OF THE DRAWINGS

Exemplary embodiments of the present invention will be described in detail based on the following figures, wherein.

DETAILED DESCRIPTION

A charging device and an image forming apparatus according to a first exemplary embodiment of the present invention will now be described with reference to FIGS. 1 to 29.

Overall Configuration

Figure 29:
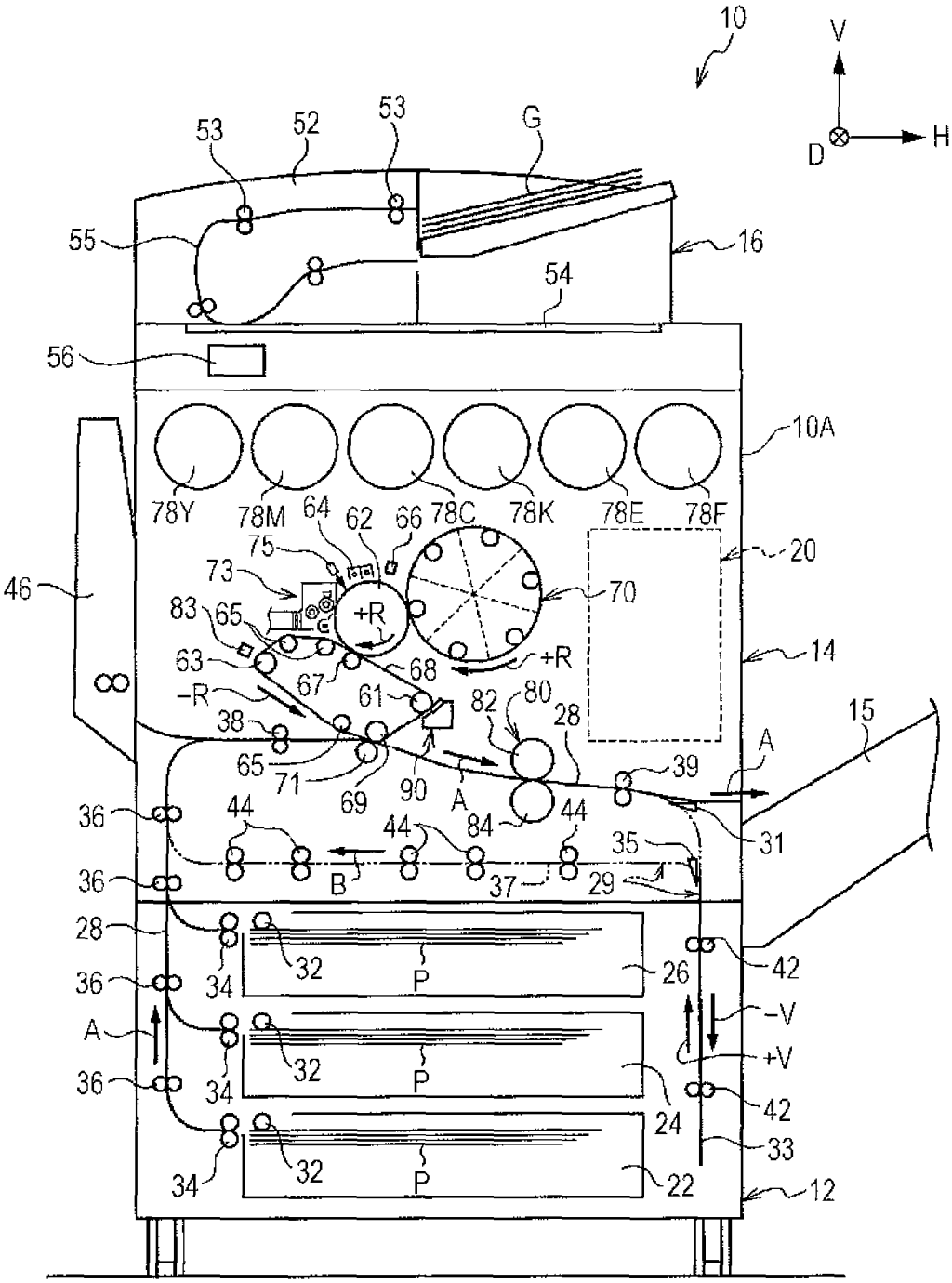
FIG. 29 is a schematic diagram of the image forming apparatus according to the first exemplary embodiment of the present invention.

Referring to FIG. 29, an image forming apparatus 10 according to the first exemplary embodiment includes, from the bottom to the top thereof in the vertical direction (the direction of arrow V), a storage section 12 in which sheet members P as recording media are stored, an image forming section 14 provided above the storage section 12 and configured to form an image on each of the sheet members P fed thereto from the storage section 12, a document reading section 16 provided above the image forming section 14 and configured to read a to-be-read document G, and a controller 20 provided in the image forming section 14 and configured to control the operations of various elements included in the image forming apparatus 10.

Hereinafter, the vertical direction (the direction of arrow V illustrated in FIG. 29), the horizontal direction (the direction of arrow H illustrated in FIG. 29), and the depth direction (the direction of arrow D illustrated in FIG. 29) of an apparatus body 10A of the image forming apparatus 10 are simply referred to as the vertical direction, the horizontal direction, and the depth direction, respectively.

The storage section 12 includes a first storage unit 22, a second storage unit 24, and a third storage unit 26 that store sheet members P of respectively different sizes. The first storage unit 22, the second storage unit 24, and the third storage unit 26 are provided with respective feed rollers 32 that feed the sheet members P stored therein into a transport path 28 defined in the image forming apparatus 10.

Transport rollers 34 and transport rollers 36 that transport the sheet members P one by one are provided on the transport path 28 on the downstream side in the direction of transport of the sheet member P (hereinafter simply referred to as the downstream side in the direction of transport) with respect to the feed rollers 32. Registration rollers 38 are also provided on the transport path 28 on the downstream side in the direction of transport with respect to the transport rollers 36. The registration rollers 38 temporarily stop the sheet member P and then feed the sheet member P to a second transfer position, described separately below, with a predetermined timing.

A downstream portion of the transport path 28 defined below the image forming section 14 extends, in front view of the image forming apparatus 10, from the lower left of the image forming section 14 to a sheet output portion 15 provided on a right sidewall of the image forming section 14. The transport path 28 is connected to a duplex transport path 29 into which the sheet member P is transported and is reversed so that images are formed on both sides of the sheet member P.

The duplex transport path 29 includes, in front view of the image forming apparatus 10, a first switching member 31 that switches the transport path 28 and the duplex transport path 29 therebetween, a reversing portion 33 extending from the lower right of the image forming section 14 and linearly in the vertical direction along the right side of the storage section 12, a transport portion 37 into which the trailing end of the sheet member P transported into the reversing portion 33 is introduced and along which the sheet member P is transported in the horizontal direction, and a second switching member 35 that switches the reversing portion 33 and the transport portion 37 therebetween. Transport rollers 42 are provided at plural positions of the reversing portion 33 at specific intervals. Transport rollers 44 are provided at plural positions of the transport portion 37 at specific intervals.

The first switching member 31 has a triangular-prism-like shape in sectional view and is moved by a drive unit (not illustrated) such that the tip thereof is oriented toward either of the transport path 28 and the duplex transport path 29, whereby the direction of transport of the sheet member P is changed. Likewise, the second switching member 35 has a triangular-prism-like shape in sectional view and is moved by a drive unit (not illustrated) such that the tip thereof is oriented toward either of the reversing portion 33 and the transport portion 37, whereby the direction of transport of the sheet member P is changed.

An end of the transport portion 37 on the downstream side in the direction of transport is connected to the transport path 28 with a guide member (not illustrated). A foldable manual-sheet-feed portion 46 is provided on the left sidewall of the image forming section 14. The manual-sheet-feed portion 46 is connected to a portion of the transport path 28 before the registration rollers 38.

The document reading section 16 provided at the top of the image forming apparatus 10 includes a document transport device 52 that automatically transports the to-be-read document G one piece at a time, a platen glass 54 provided below the document transport device 52 and on which a piece of to-be-read document G is to be placed, and a document reading device 56 that reads each piece of to-be-read document G transported by the document transport device 52 or placed on the platen glass 54.

The document transport device 52 has an automatic transport path 55 on which plural transport rollers 53 are provided. A portion of the automatic transport path 55 is defined such that the to-be-read document G runs on the platen glass 54. The document reading device 56 is stationary at the left end of the platen glass 54 when reading the to-be-read document G transported by the document transport device 52, and moves in the horizontal direction when reading the to-be-read document G placed on the platen glass 54.

The image forming section 14 provided below the document reading section 16 includes an image carrier 62 having a cylindrical shape. The image carrier 62 resides in the middle part of the apparatus body 10A of the image forming apparatus 10 and is configured to carry a toner image to be formed on the surface thereof. The image carrier 62 is rotated in the direction of arrow +R (clockwise direction in FIG. 29) by a drive unit (not illustrated) and carries an electrostatic latent image that is formed by application of light thereto. A scorotron charging device 64 that charges the surface of the image carrier 62 is provided above the image carrier 62 in such a manner as to face the surface of the image carrier 62. Details of the charging device 64 will be described separately below.

An exposure device 66 is provided at a position on the downstream side in the direction of rotation of the image carrier 62 with respect to the charging device 64 in such a manner as to face the surface of the image carrier 62. The exposure device 66 includes a light-emitting diode (LED) and is configured to apply light to (perform exposure on) the surface of the image carrier 62 that is charged in advance by the charging device 64. The light is applied in accordance with image signals corresponding to different toner colors. Thus, an electrostatic latent image is formed on the surface of the image carrier 62. The exposure device 66 is not limited to be of an LED type and may be, for example, configured to perform laser-beam scanning with a polygon mirror.

A developing device 70 of a rotary switching type is provided on the downstream side in the direction of rotation of the image carrier 62 with respect to a position to which the exposure device 66 applies exposure light. The developing device 70 develops and visualizes, with toners of predetermined colors, the electrostatic latent image formed on the surface of the image carrier 62.

Figure 28:
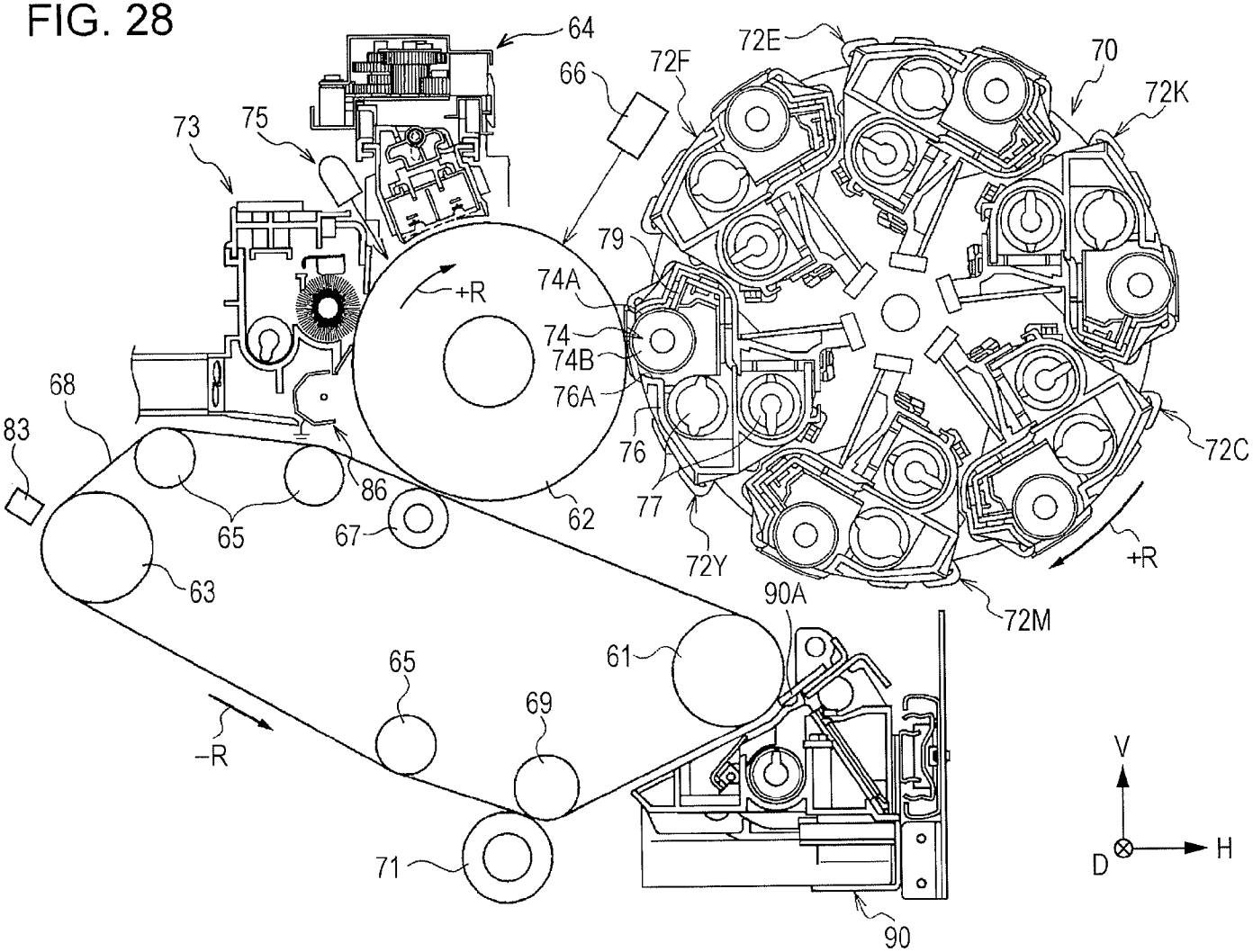
FIG. 28 is another diagram illustrating the charging device, the image carrier, and other elements included in the image forming apparatus according to the first exemplary embodiment of the present invention.

Referring to FIG. 28, the developing device 70 includes developing units 72Y, 72M, 72C, 72K, 72E, and 72F corresponding to respective toner colors of yellow (Y), magenta (M), cyan (C), black (K), a first special color (E), and a second special color (F) and arranged in that order in the circumferential direction (in the counterclockwise direction). The developing device 70 is rotated by a center angle of 60 degrees at a time by a motor (a rotating unit, not illustrated), whereby which of the developing units 72Y, 72M, 72C, 72K, 72E, and 72F is used for performing development is switched thereamong. Thus, one of the developing units 72Y, 72M, 72C, 72K, 72E, and 72F faces the surface of the image carrier 62. Since the developing units 72Y, 72M, 72C, 72K, 72E, and 72F all have the same configuration, the developing unit 72Y will be described herein, and descriptions of the other developing units 72M, 72C, 72K, 72E, and 72F are omitted.

The developing unit 72Y includes a case member 76 that forms the body thereof. The case member 76 is filled with developer (not illustrated) composed of toner and carrier. The developer is supplied from a toner cartridge 78Y (see FIG. 29) through a toner supply path (not illustrated). The case member 76 has a rectangular opening 76A that faces the surface of the image carrier 62. A developing roller 74 is provided in the opening 76A such that the surface thereof faces the surface of the image carrier 62. A plate-like regulating member 79 that regulates the thickness of a layer of the developer is also provided in the case member 76 at a position near the opening 76A. The regulating member 79 extends in the longitudinal direction of the opening 76A.

The developing roller 74 includes a rotatable developing sleeve 74A having a cylindrical shape and a magnetic member 74B secured on the inner side of the developing sleeve 74A and having plural magnetic poles. When the developing sleeve 74A rotates, a magnetic brush made of the developer (carrier) is formed and the regulating member 79 regulates the thickness of the magnetic brush, whereby a developer layer is formed on the surface of the developing sleeve 74A. The developer layer on the surface of the developing sleeve 74A is transported to a position facing the image carrier 62, and the toner is made to adhere to the latent image (electrostatic latent image) formed on the surface of the image carrier 62. Thus, development is performed.

Two transport augers 77 each having a spiral shape are rotatably provided side by side in the case member 76. When the two transport augers 77 rotate, the developer in the case member 76 is circulated and is transported in the axial direction of the developing roller 74 (the longitudinal direction of the developing unit 72Y). The developing units 72Y, 72M, 72C, 72K, 72E, and 72F have, in total, six respective developing rollers 74. The developing rollers 74 are arranged in the circumferential direction such that the distance between each pair of adjacent developing rollers 74 corresponds to a center angle of 60 degrees. With a single action of switching among the developing units 72, the next one of the developing rollers 74 faces the surface of the image carrier 62.

An intermediate transfer belt 68 is provided on the downstream side in the direction of rotation of the image carrier 62 with respect to the developing device 70 and below the image carrier 62. The toner image formed on the surface of the image carrier 62 is transferred to the intermediate transfer belt 68. The intermediate transfer belt 68 is endless and is stretched around a driving roller 61 that is driven to rotate by the controller 20, a tension applying roller 63 that applies tension to the intermediate transfer belt 68, plural transport rollers 65 that are in contact with the inner surface of the intermediate transfer belt 68 and rotate by following the rotation of the intermediate transfer belt 68, and an assist roller 69 that is in contact with the inner surface of the intermediate transfer belt 68 and rotates by following the rotation of the intermediate transfer belt 68. When the driving roller 61 rotates, the intermediate transfer belt 68 rotates in the direction of arrow –R (counterclockwise direction in FIG. 28).

A first transfer roller 67 is provided across the intermediate transfer belt 68 from the image carrier 62. The first transfer roller 67 performs first transfer of the toner image formed on the surface of the image carrier 62 to the intermediate transfer belt 68. The first transfer roller 67 is in contact with the inner surface of the intermediate transfer belt 68 at a position on the downstream side in the direction of rotation of the intermediate transfer belt 68 with respect to a position at which the image carrier 62 is in contact with the intermediate transfer belt 68. When power is supplied to the first transfer roller 67 from a power source (not illustrated), the first transfer roller 67 causes the toner image on the image carrier 62 to be first-transferred to the intermediate transfer belt 68 by utilizing the potential difference from the image carrier 62, which is grounded.

A second transfer roller 71 is provided across the intermediate transfer belt 68 from the assist roller 69. The second transfer roller 71 performs second transfer of the toner image first-transferred to the intermediate transfer belt 68 to the sheet member P. The nip between the second transfer roller 71 and the assist roller 69 is defined as a second transfer position at which the toner image is transferred to the sheet member P. The second transfer roller 71 is in contact with the outer surface of the intermediate transfer belt 68. The second transfer roller 71 is grounded. A bias is applied to the shaft of the assist roller 69 by a power source (not illustrated). The toner image on the intermediate transfer belt 68 is second-transferred to the sheet member P by utilizing the potential difference between the biased assist roller 69 and the grounded second transfer roller 71.

A cleaning device 90 including a blade 90A is provided across the intermediate transfer belt 68 from the driving roller 61. The blade 90A scrapes toner remaining on the intermediate transfer belt 68 after the second transfer.

A position detecting sensor 83 is provided at a position on the outer peripheral side of the intermediate transfer belt 68 and facing the tension applying roller 63. The position detecting sensor 83 detects a predetermined reference position defined on the intermediate transfer belt 68 by detecting a mark (not illustrated) provided on the outer surface of the intermediate transfer belt 68, and outputs a position detection signal with reference to which an image forming process is started.

A corotron adjusting charger 86 is provided on the downstream side in the direction of rotation of the image carrier 62 with respect to the first transfer roller 67. The adjusting charger 86 negatively charges the surface of the image carrier 62, thereby adjusting the potential of the charge on the surface of the image carrier 62. A cleaning device 73 is provided on the downstream side in the direction of rotation of the image carrier 62 with respect to the adjusting charger 86. The cleaning device 73 removes toner and the like remaining on the surface of the image carrier 62 without being first-transferred to the intermediate transfer belt 68.

A static eliminating device 75 is provided on the downstream side in the direction of rotation of the image carrier 62 with respect to the cleaning device 73 (on the upstream side with respect to the charging device 64). The static eliminating device 75 eliminates static electricity from the surface of the image carrier 62 by applying light to the image carrier 62.

Referring to FIG. 29, the second transfer position at which the second transfer of the toner image is performed by the second transfer roller 71 is defined at a halfway position of the transport path 28. A fixing device 80 is provided on the transport path 28 on the downstream side in the direction of transport of the sheet member P (indicated by arrow A) with respect to the second transfer roller 71. The fixing device 80 fixes, on the Sheet member P, the toner image transferred to the sheet member P by the second transfer roller 71.

The fixing device 80 includes a heating roller 82 and a pressure roller 84. The heating roller 82 is provided on a side (upper side) of the sheet member P having the toner image and includes a heat source that generates heat when power is supplied thereto. The pressure roller 84 is provided below the heating roller 82 and presses the sheet member P against the surface of the heating roller 82. Transport rollers 39 are provided on the transport path 28 on the downstream side in the direction of transport of the sheet member P with respect to the fixing device 80. The transport rollers 39 transport the sheet member P toward the sheet output portion 15 or the reversing portion 33.

Toner cartridges 78Y, 78M, 78C, 78K, 78E, and 78F that are individually changeable are provided side by side in the horizontal direction below the document reading device 56 and above the developing device 70. The toner cartridges 78Y, 78M, 78C, 78K, 78E, and 78F contain toners having respective colors of yellow (Y), magenta (M), cyan (C), black (K), the first special color (E), and the second special color (F).

The first special color E and the second special color F are selected from special colors (including a transparent color) other than yellow, magenta, cyan, and black, or are otherwise not selected. If any colors are selected as the first and second special colors E and F, the developing device 70 performs image formation by using the six colors of Y, M, C, K, E, and F. If no colors are selected as the first and second special colors E and F, the developing device 70 performs image formation by using the four colors of Y, M, C, and K. The first exemplary embodiment concerns a case where image formation is performed by using the four colors of Y, M, C, and K without using the first and second special colors E and F. As an alternative, image formation may be performed by using five colors in total: the four colors of Y, M, C, and K and one of the first and second special colors E and F.

In the configuration illustrated in FIG. 29, when the image forming apparatus 10 is activated, the exposure device 66 receives pieces of image data for the respective colors of yellow (Y), magenta (M), cyan (C), and black (K) that are sequentially output from an image processing apparatus (not illustrated) or any external apparatus. At this time, the developing device 70 is rotated and retained such that, for example, the developing unit 72Y (see FIG. 28) faces the surface of the image carrier 62. Furthermore, the blade 90A of the cleaning device 90 and the second transfer roller 71 are held away from the outer surface of the intermediate transfer belt 68 before toner images in the respective colors are multiply transferred (first-transferred) to the intermediate transfer belt 68.

Subsequently, light is emitted from the exposure device 66 in accordance with one of the pieces of image data, and the surface of the image carrier 62 that has been charged by the charging device 64 is exposed to the light. Thus, an electrostatic latent image corresponding to the piece of image data for, for example, yellow is formed on the surface of the image carrier 62. The electrostatic latent image thus formed on the surface of the image carrier 62 is developed into a yellow toner image by the developing unit 72Y. The yellow toner image on the surface of the image carrier 62 is then transferred to the intermediate transfer belt 68 by the first transfer roller 67.

Subsequently, the developing device 70 is rotated by 60 degrees in the direction of arrow +R, whereby the developing unit 72M faces the surface of the image carrier 62. Through the processes of charging, exposure, and development, a magenta toner image is formed on the surface of the image carrier 62 and is transferred to the intermediate transfer belt 68 by the first transfer roller 67 in such a manner as to be superposed on the yellow toner image. Likewise, cyan and black toner images are sequentially and multiply transferred to the intermediate transfer belt 68. When the transfer of the toner images to the intermediate transfer belt 68 is finished, the blade 90A of the cleaning device 90 and the second transfer roller 71 are brought into contact with the outer surface of the intermediate transfer belt 68.

Meanwhile, the sheet member P that has been fed from the storage section 12 and has been transported along the transport path 28 is transported to the second transfer position by the registration rollers 38 with the timing of the multiple transfer of the toner images to the intermediate transfer belt 68. The toner images that have been multiply transferred to the intermediate transfer belt 68 are second-transferred by the second transfer roller 71 to the sheet member P that has been transported to the second transfer position. Furthermore, toner remaining on the surface of the intermediate transfer belt 68 is scraped off the intermediate transfer belt 68 by the blade 90A and is collected in the cleaning device 90.

Subsequently, the sheet member P having the toner images transferred thereto is transported in the direction of arrow A (to the right in FIG. 29) toward the fixing device 80. In the fixing device 80, heat and pressure are applied to the toner images by the heating roller 82 and the pressure roller 84, whereby the toner images are fixed on the sheet member P. Furthermore, the sheet member P having the fixed toner images thereon is, for example, output to the sheet output portion 15. When images are to be formed on both sides of the sheet member P, the sheet member P having the toner images fixed on the front side thereof by the fixing device 80 is fed into the reversing portion 33 in the direction of arrow −V and is fed out in the direction of arrow +V, whereby the leading end and the trailing end of the sheet member P are reversed. Subsequently, the sheet member P is transported along the duplex transport path 29 in the direction of arrow B (to the left in FIG. 29) and is fed into the transport path 28. Then, image formation and fixing are performed on the back side of the sheet member P in the same manner as for the front side.

Feature Configuration

The charging device 64 will now be described.

Figure 8:
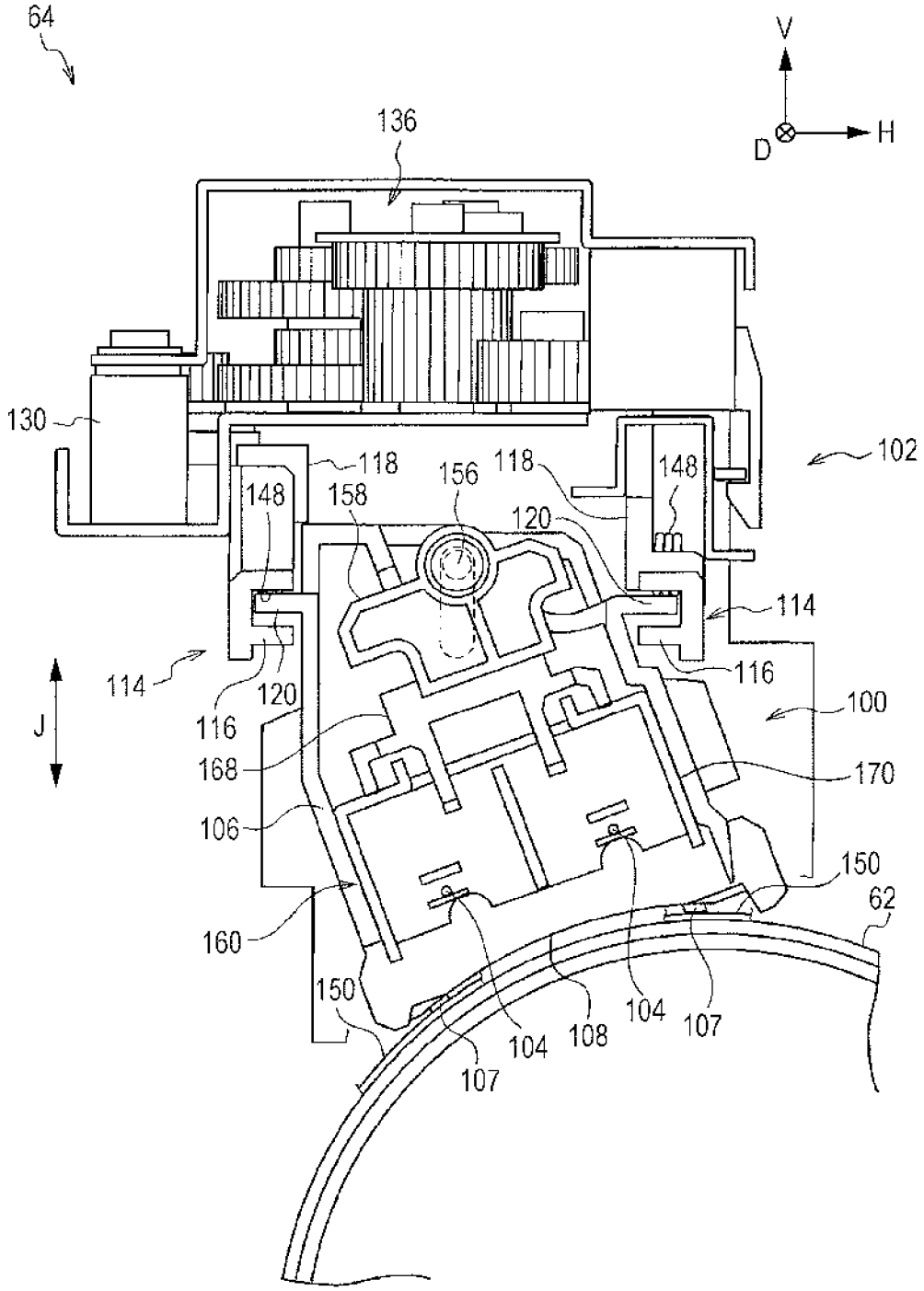
FIG. 8 is another sectional view of the charging device according to the first exemplary embodiment of the present invention.
Figure 27:
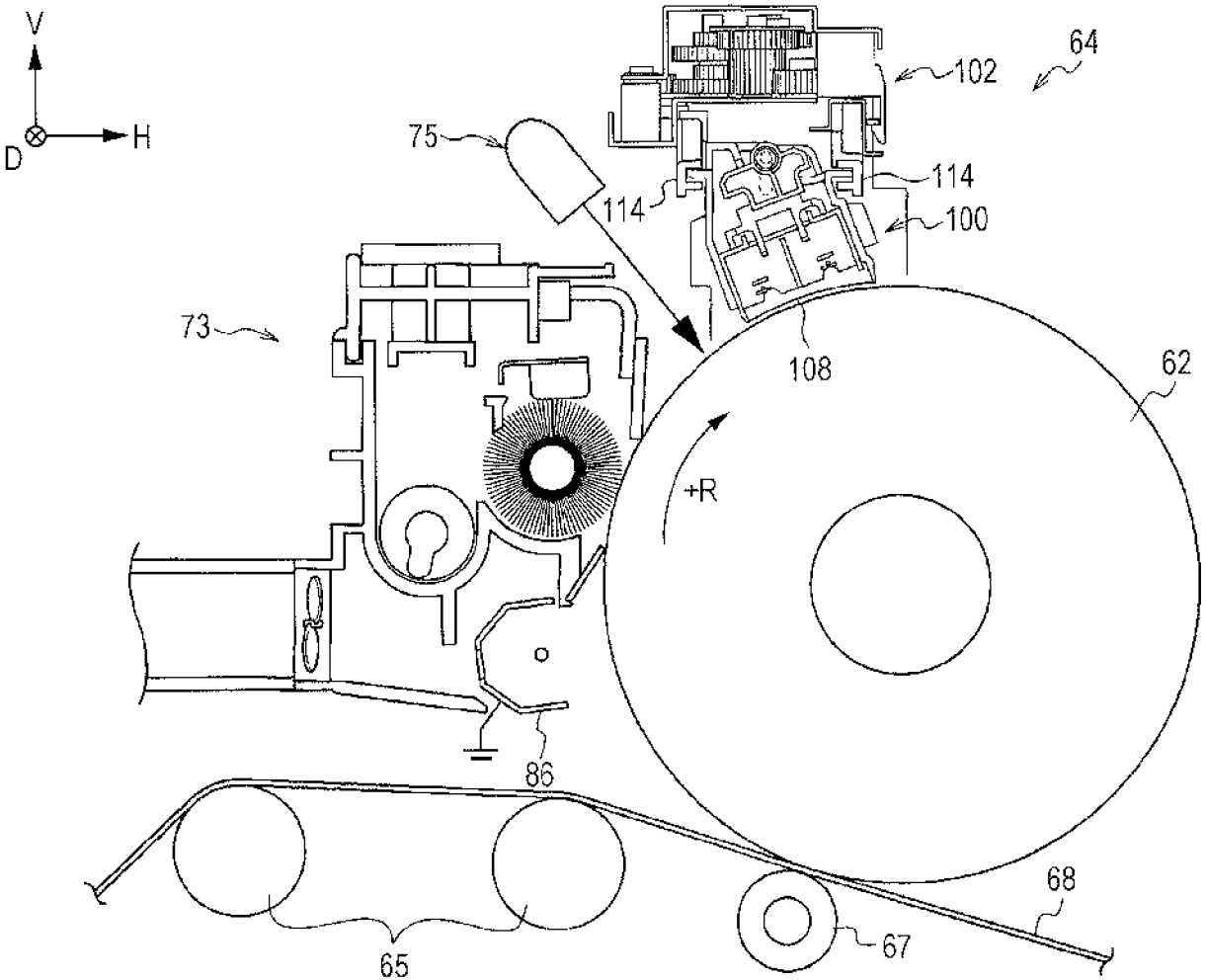
FIG. 27 is a diagram illustrating the charging device, the image carrier, and other elements included in the image forming apparatus according to the first exemplary embodiment of the present invention.

Referring to FIGS. 8 and 27, the charging device 64 includes a charger 100 and a device body 102 that supports the charger 100. The charger 100 faces the image carrier 62 and extends in the direction of the rotational axis of the image carrier 62 (hereinafter simply referred to as the direction of the rotational axis, which corresponds to the depth direction in the first exemplary embodiment).

A pair of rail members 114 as exemplary support members are provided on the device body 102. The rail members 114 hold the charger 100 therebetween from two respective sides in the horizontal direction such that the charger 100 is attachable to and detachable from the device body 102 in the direction of the rotational axis. The rail members 114 thus supporting the charger 100 are movable in a direction toward or away from the surface of the image carrier 62 (the direction of arrow J illustrated in FIG. 8).

Figure 21:
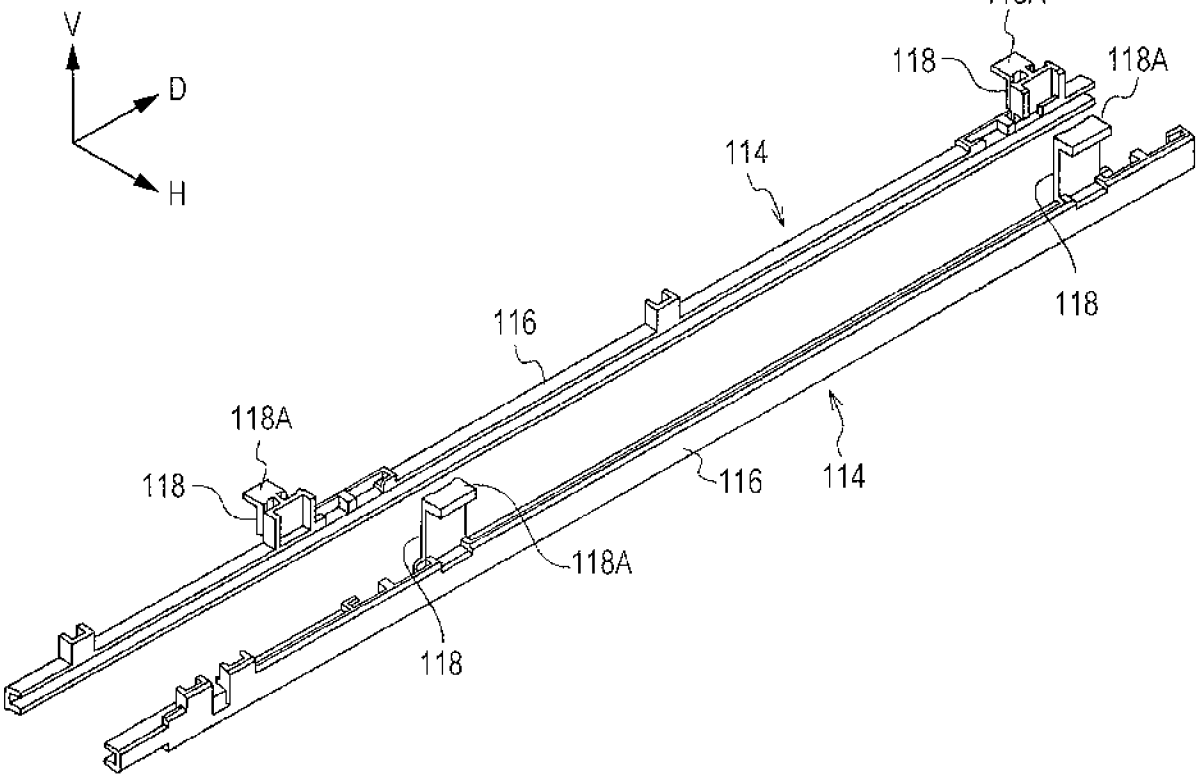
FIG. 21 is a perspective view of rail members included in the charging device according to the first exemplary embodiment of the present invention.
Figure 22:
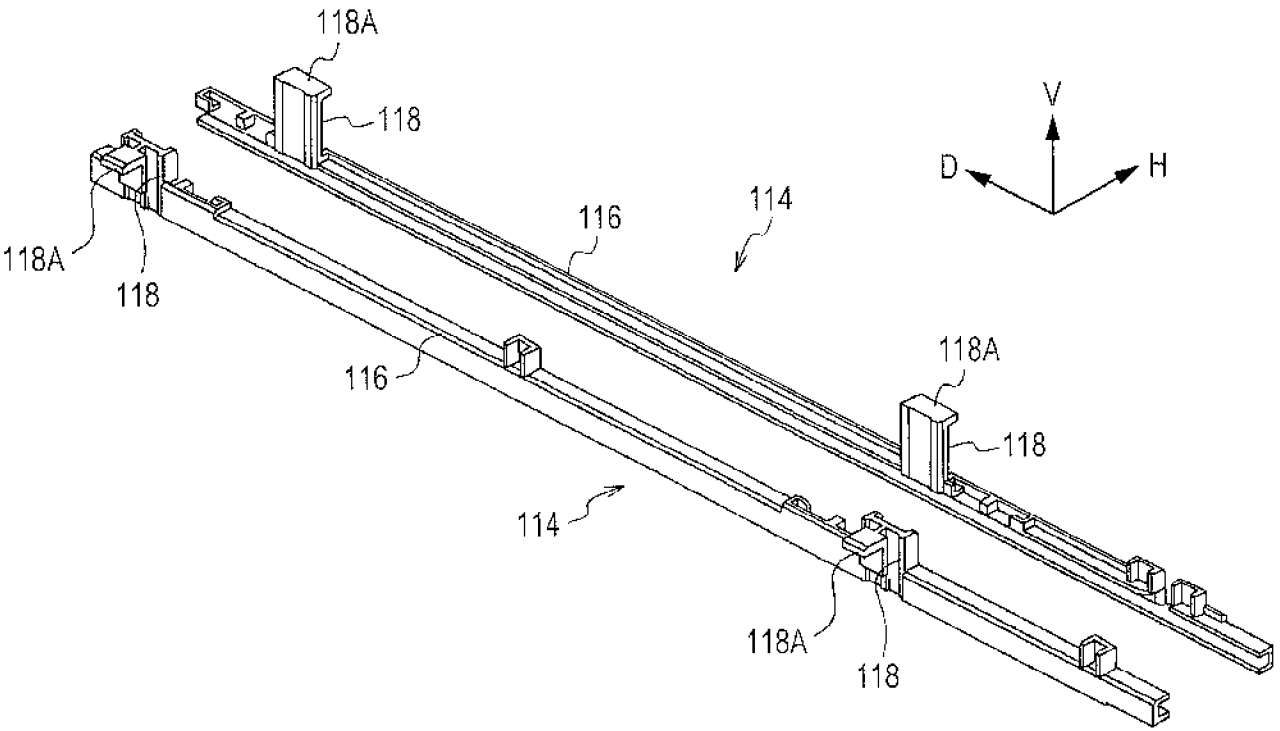
FIG. 22 is another perspective view of the rail members included in the charging device according to the first exemplary embodiment of the present invention.
Figure 24:
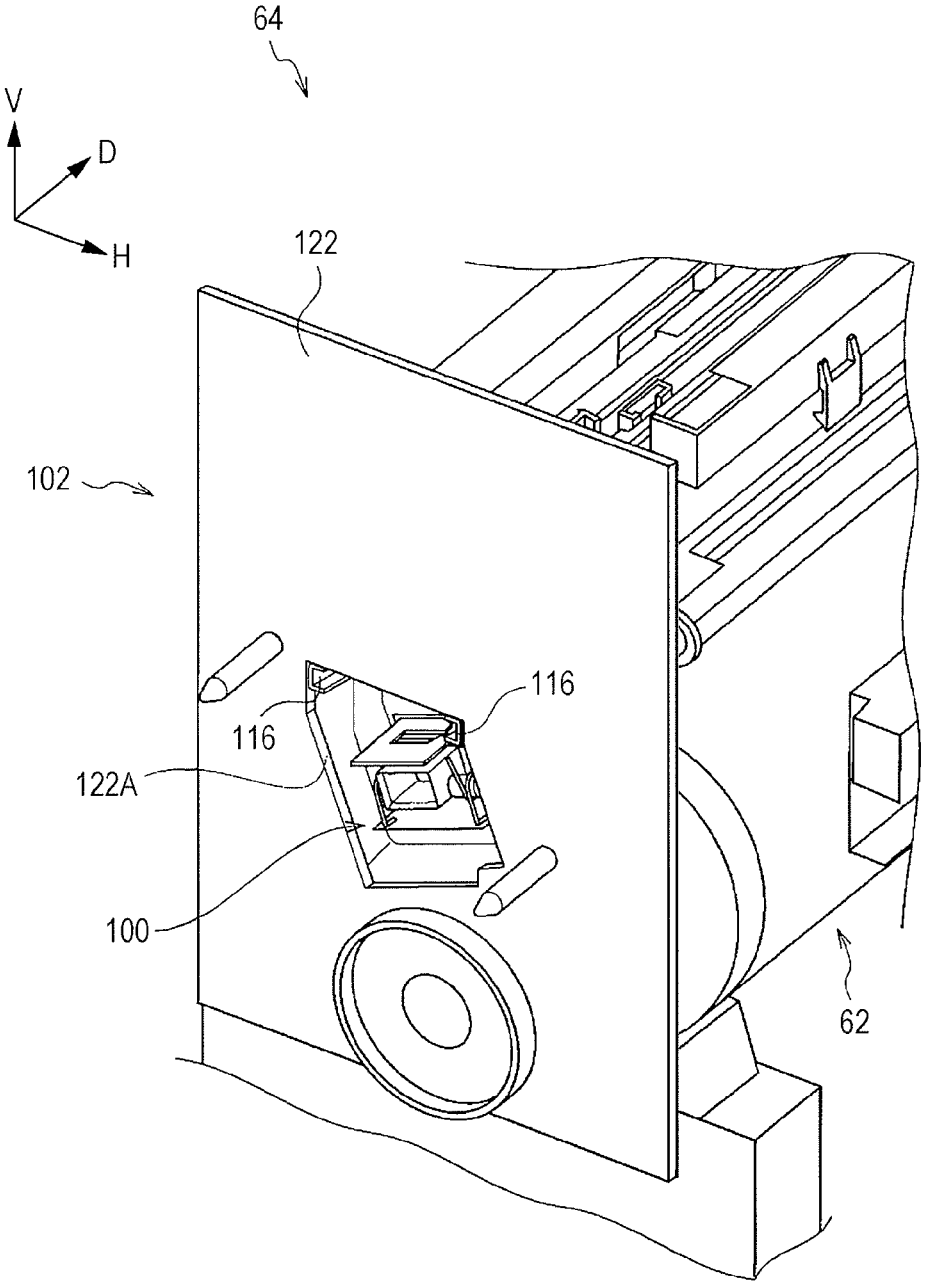
FIG. 24 is yet another enlarged perspective view of the charging device according to the first exemplary embodiment of the present invention.
Figure 25:
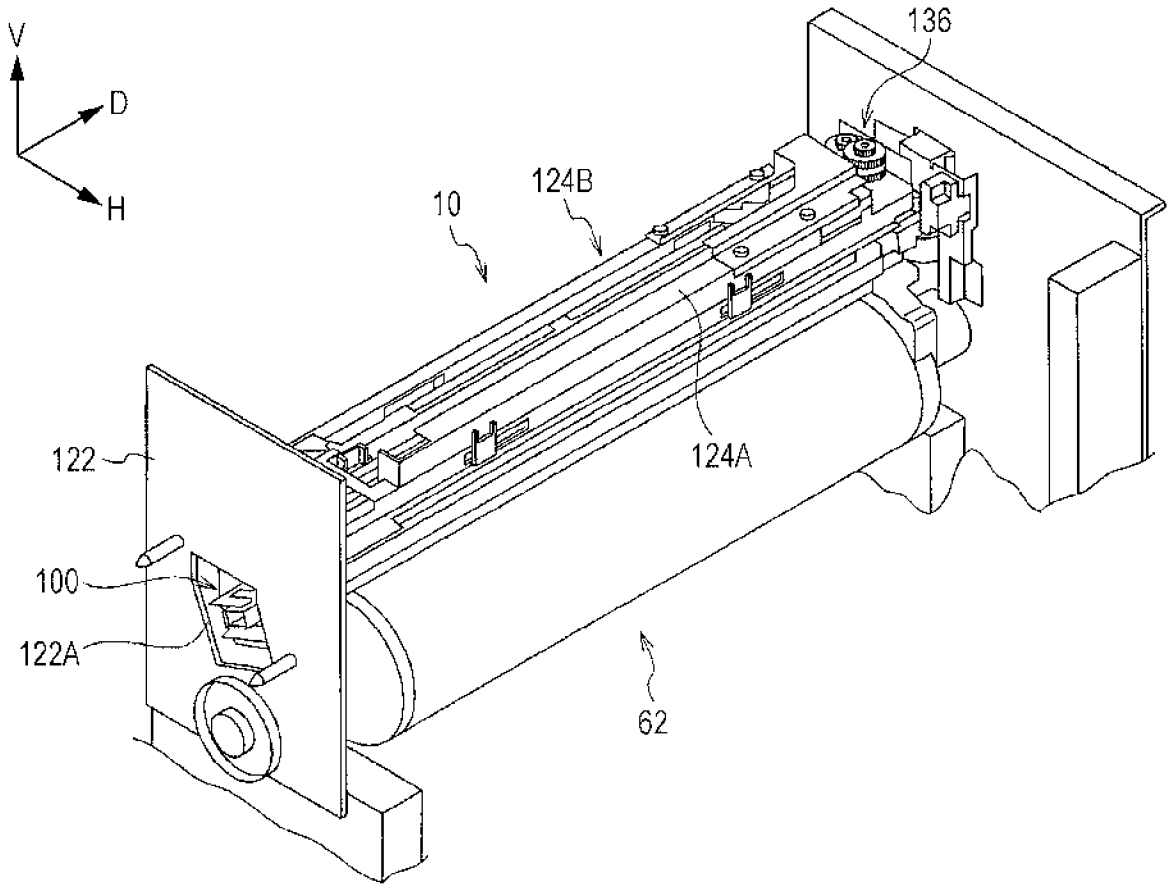
FIG. 25 is a perspective view of the charging device and an image carrier included in an image forming apparatus according to the first exemplary embodiment of the present invention.

Referring to FIGS. 8, 21, and 22, the pair of rail members 114 each include a rail portion 116 and hook portions 118. The rail portion 116 extends in the direction of the rotational axis. The hook portions 118 extend upward from near two respective ends of the rail portion 116. The top end of each of the hook portions 118 is bent outward with respect to the charger 100 and thus forms a plate-like contact portion 118A. The sections of the rail portions 116 taken in a direction intersecting the longitudinal direction have rectangular U shapes whose open sides face each other. Referring to FIG. 24, one end of each of the rail portions 116 (the end on the near side in the depth direction) is a free end positioned in an opening 122A provided in a support plate 122 provided on the device body 102.

The charger 100 has a pair of plate-like guide portions 120 as exemplary contact members. The pair of guide portions 120 are inserted into the respective rail portions 116, whose sections have rectangular U shapes, in the direction of the rotational axis. By inserting and removing the guide portions 120 into and from the respective rail portions 116 in the direction of the rotational axis, the charger 100 is attachable to and detachable from the device body 102 through the opening 122A (see FIGS. 25 and 26) and at a retracted position described separately below.

Figure 5:
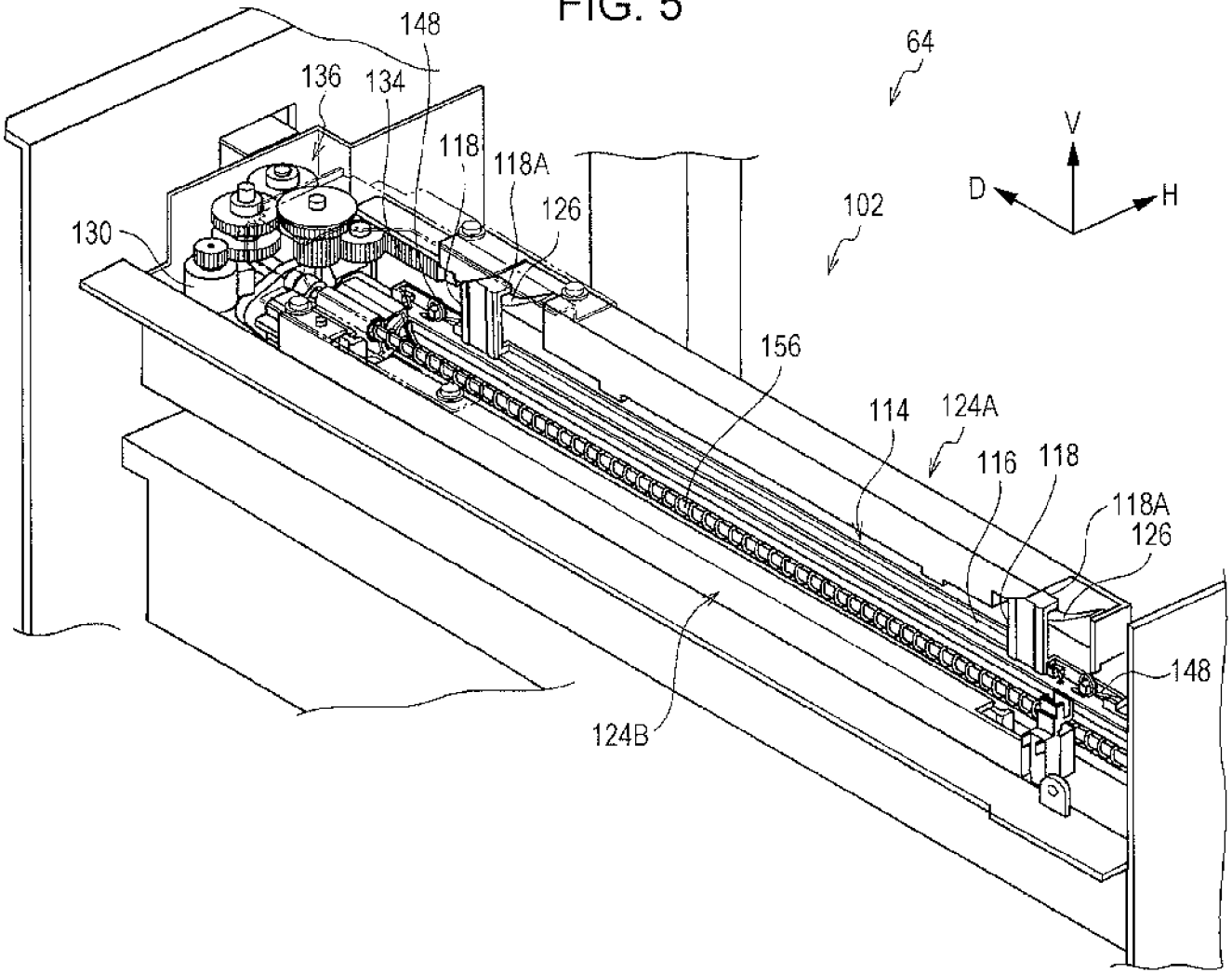
FIG. 5 is a perspective view of the charging device according to the first exemplary embodiment of the present invention.
Figure 6:
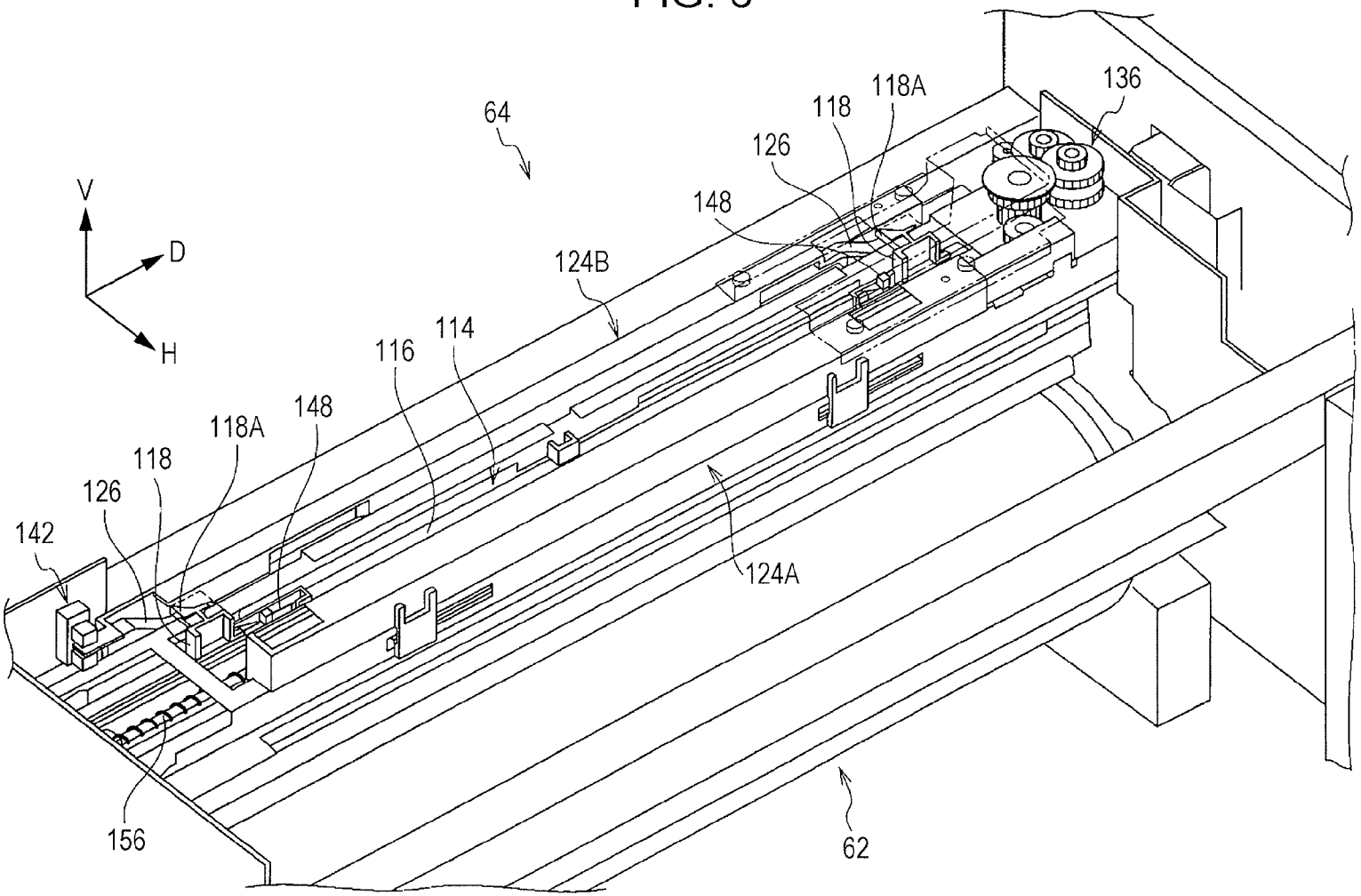
FIG. 6 is another perspective view of the charging device according to the first exemplary embodiment of the present invention.

Referring to FIGS. 5 and 6, a pair of movable members 124 are supported by the device body 102 in such a manner as to be movable in the direction of the rotational axis relative to the device body 102. The movable members 124 extend in the direction of the rotational axis and support the respective rail members 114.

Specifically, when the charging device 64 is seen from the front, the movable members 124 include a movable member 124A provided on the right side and a movable member 124B provided on the left side. (In the following description, the suffixes A and B may be omitted if there is no need to distinguish between the movable member 124A and the movable member 124B.)

The movable members 124 each have sloping portions 126 at two respective ends thereof in the longitudinal direction. The sloping portions 126 slope in the direction of the rotational axis such that the distance thereto from the image carrier 62 varies. The contact portions 118A of the rail members 114 are in contact with and supported by the respective sloping portions 126.

Referring to FIGS. 1 to 4, by moving the movable members 124 in the direction of the rotational axis, a force produced by the movement is transmitted to the contact portions 118A such that the contact portions 118A move in the direction toward or away from the image carrier 62 by sliding along the respective sloping portions 126.

With the movement of the contact portions 118A in the direction toward or away from the image carrier 62, the charger 100 supported at the guide portions 120 thereof by the respective rail members 114 moves between a charging position (see FIG. 8) at which the charger 100 is close to the surface of the image carrier 62 and charges the surface of the image carrier 62 and a retracted position (see FIG. 7) at which the charger 100 is retracted away from the surface of the image carrier 62.

Figure 1:
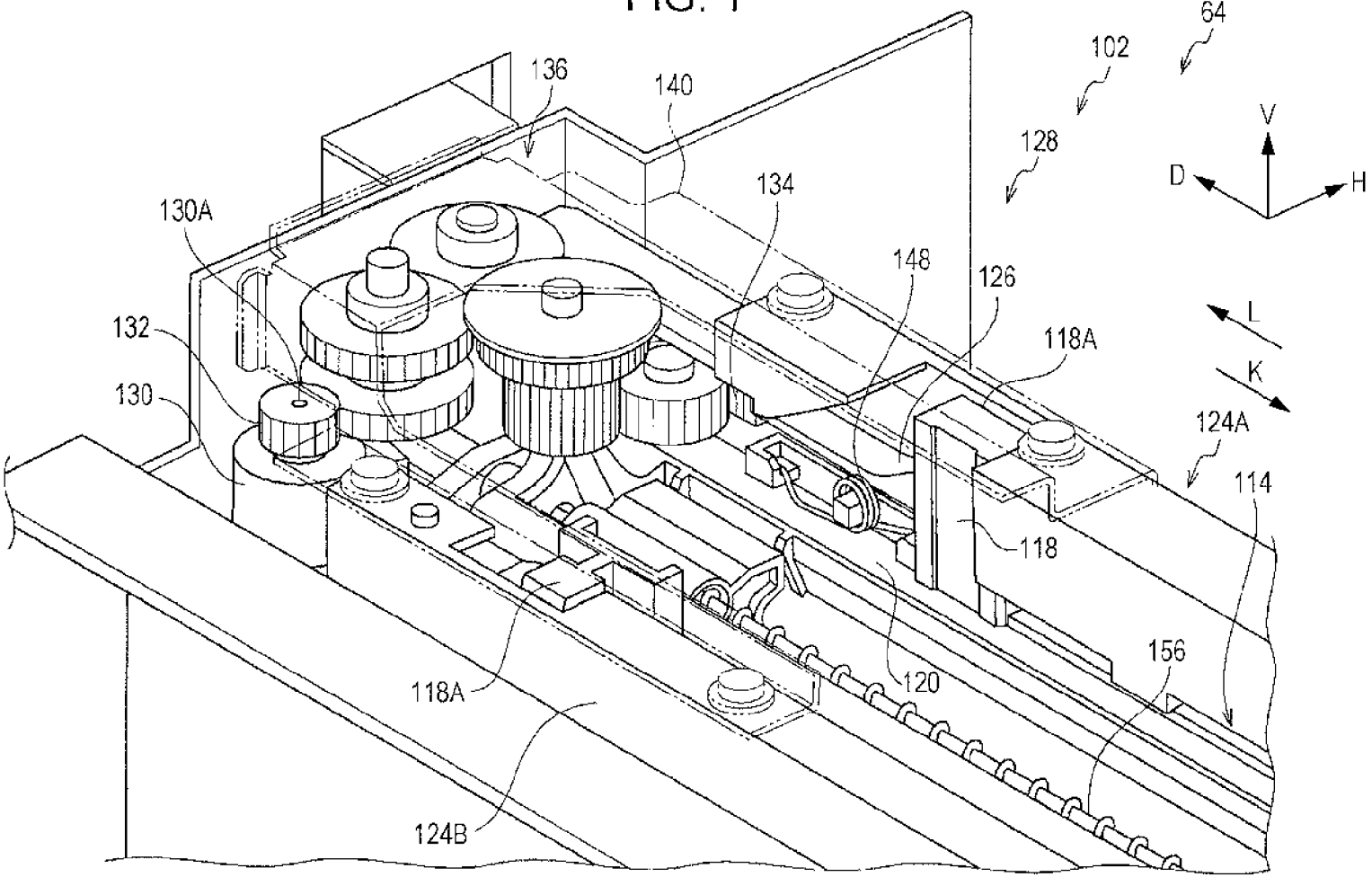
FIG. 1 is an enlarged perspective view of a charging device according to a first exemplary embodiment of the present invention.
Figure 2:
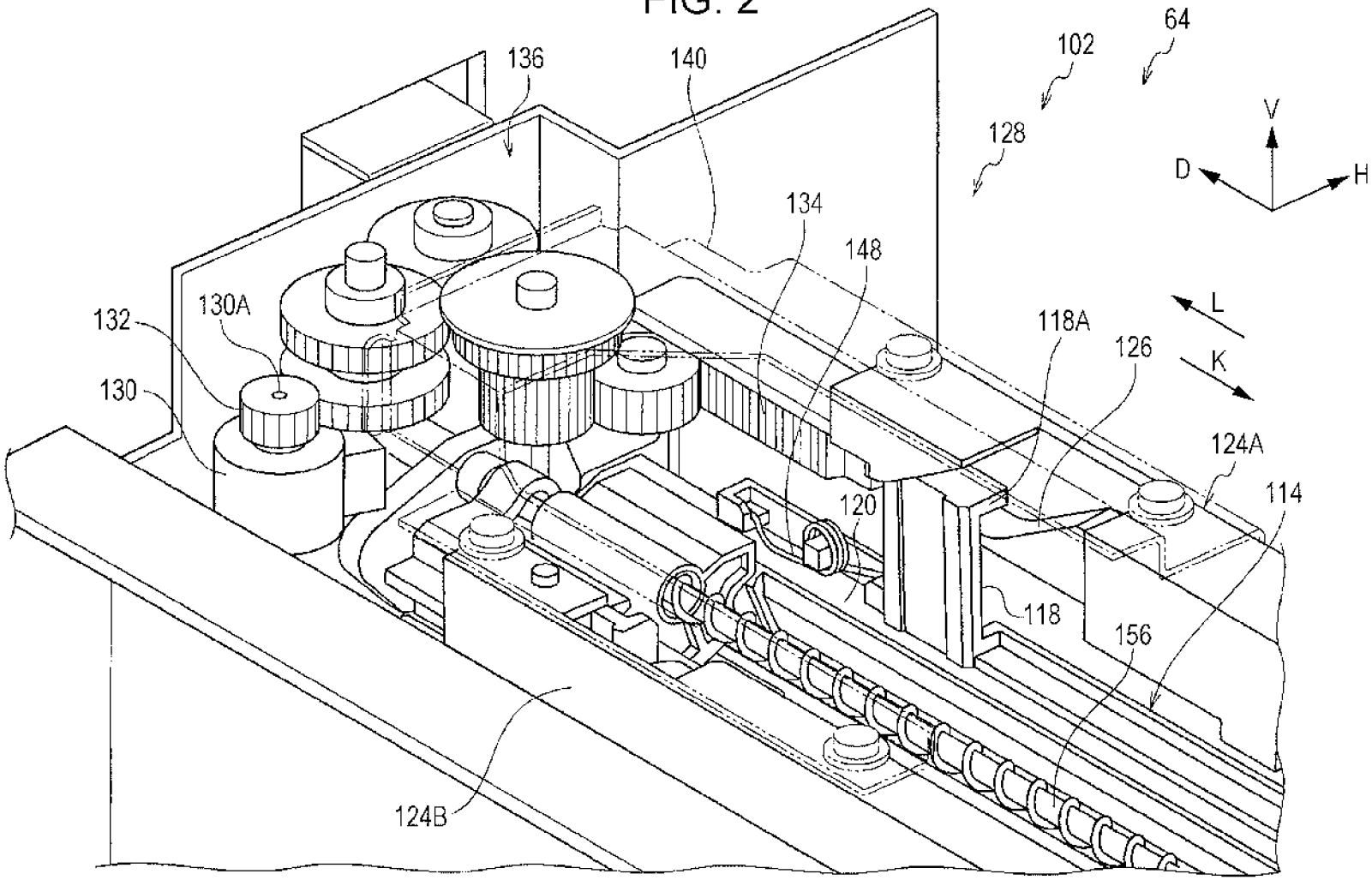
FIG. 2 is another enlarged perspective view of the charging device according to the first exemplary embodiment of the present invention.

Referring to FIGS. 1 and 2, a stepping motor 130 as an exemplary drive source is provided on the device body 102. The stepping motor 130 causes the movable members 124 to move in the direction of the rotational axis. The stepping motor 130 is provided with a driving gear 132 on a rotating shaft 130A thereof. The movable member 124A has a rack 134 extending in the direction of the rotational axis at one end thereof (the end on the rear side in the depth direction). A train of gears 136 that transmit the rotational force of the driving gear 132 to the rack 134 are provided between the driving gear 132 and the rack 134.

The movable member 124A having the rack 134 at the end thereof and the movable member 124B are connected to each other with a bracket 140 that bridges the movable member 124A and the movable member 124B. Thus, the movable member 124B is movable in the direction of the rotational axis by following the movement of the movable member 124A in the direction of the rotational axis.

In the above configuration, when the stepping motor 130 is activated in accordance with an instruction from the controller 20 (see FIG. 29), the driving force of the stepping motor 130 is transmitted to the movable member 124A having the rack 134 through the driving gear 132 and the train of gears 136. The movable member 124A that has received the driving force of the stepping motor 130 and the movable member 124B connected to the movable member 124A with the bracket 140 move in the direction of the rotational axis. With the movement of the movable members 124 in the direction of the rotational axis, the contact portions 118A move in the direction toward or away from the image carrier 62 by sliding along the respective sloping portions 126. With the movement of the contact portions 118A in the direction toward or away from the image carrier 62, the rail members 114 and the guide portions 120 supported by the respective rail members 114 move in the direction toward or away from the image carrier 62. Thus, the charger 100 is movable between the charging position (see FIG. 8) at which the charger 100 is close to the surface of the image carrier 62 and charges the surface of the image carrier 62 and the retracted position (see FIG. 7) at which the charger 100 is retracted away from the surface of the image carrier 62.

That is, the charger 100 is moved between the charging position and the retracted position by a movement mechanism 128, which includes the stepping motor 130, the train of gears 136, the rack 134, the movable members 124, the rail members 114, and so forth.

Figure 3:
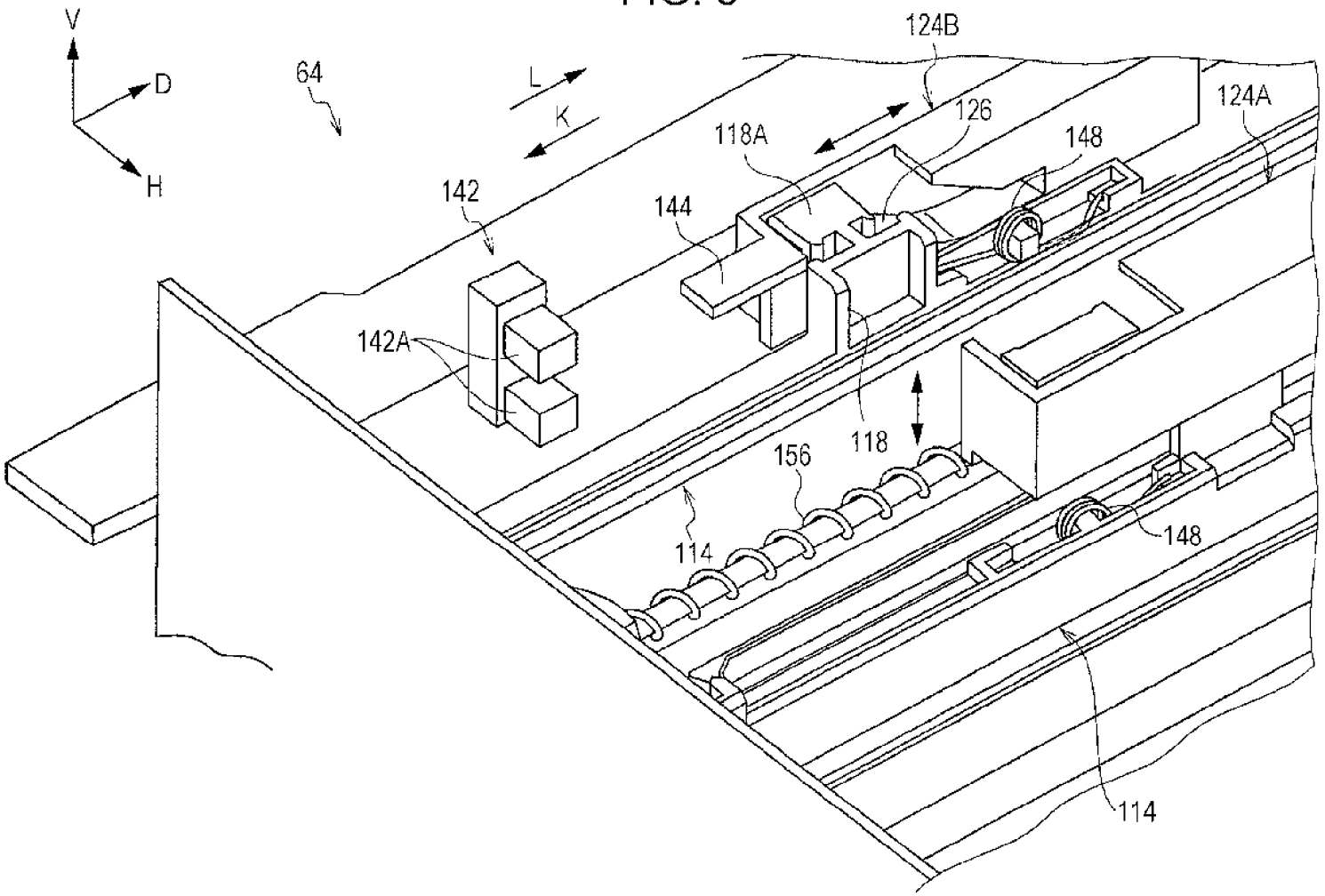
FIG. 3 is yet another enlarged perspective view of the charging device according to the first exemplary embodiment of the present invention.
Figure 4:
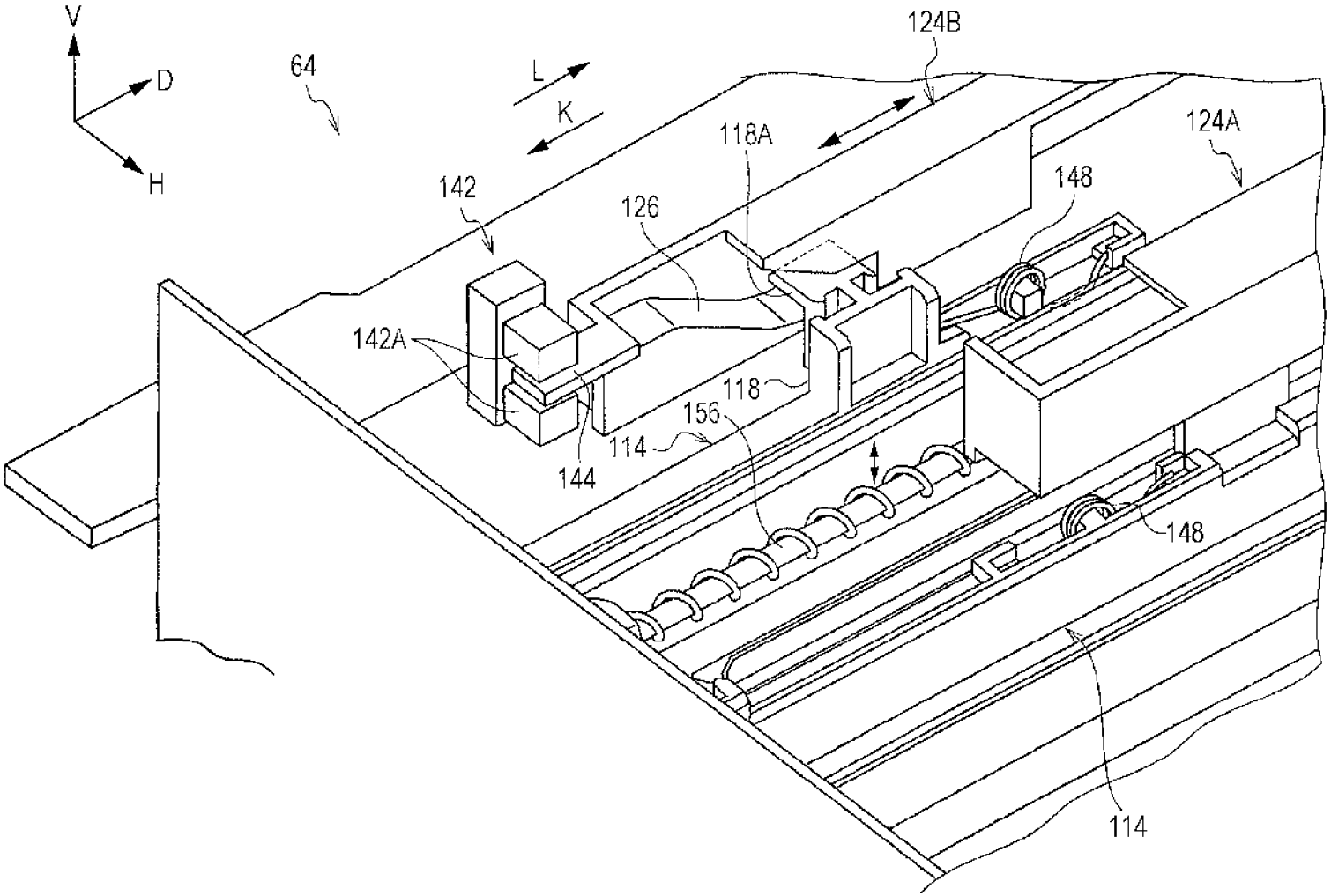
FIG. 4 is yet another enlarged perspective view of the charging device according to the first exemplary embodiment of the present invention.

Referring to FIGS. 3 and 4, the movable member 124B is provided at one end thereof (the end on the near side in the depth direction) with a plate-like detection plate 144 extending in the direction of the rotational axis and a sensor 142 as an exemplary detector that detects the detection plate 144.

Specifically, the sensor 142 includes a pair of detecting portions 142A that are spaced apart from each other in the vertical direction. When the detection plate 144 is inserted between the pair of detecting portions 142A, the sensor 142 detects the detection plate 144. Thus, when the movable member 124B moves in the direction of the rotational axis such that the charger 100 is brought to the charging position (see FIG. 8), the sensor 142 detects the detection plate 144 (see FIG. 4). When the movable member 124B moves in the direction of the rotational axis such that the charger 100 is brought to the retracted position (see FIG. 7), the sensor 142 does not detect the detection plate 144 (see FIG. 3).

Referring to FIGS. 1 to 6, torsion springs 148 as exemplary urging members are provided at two respective ends of each of the rail portions 116 in the longitudinal direction. The torsion springs 148 urge the guide portions 120 placed in the respective rail portions 116 such that the bottom surfaces of the guide portions 120 are pressed against the rail portions 116.

The charger 100 that is attachably and detachably held by the device body 102 will now be described.

Figure 10:
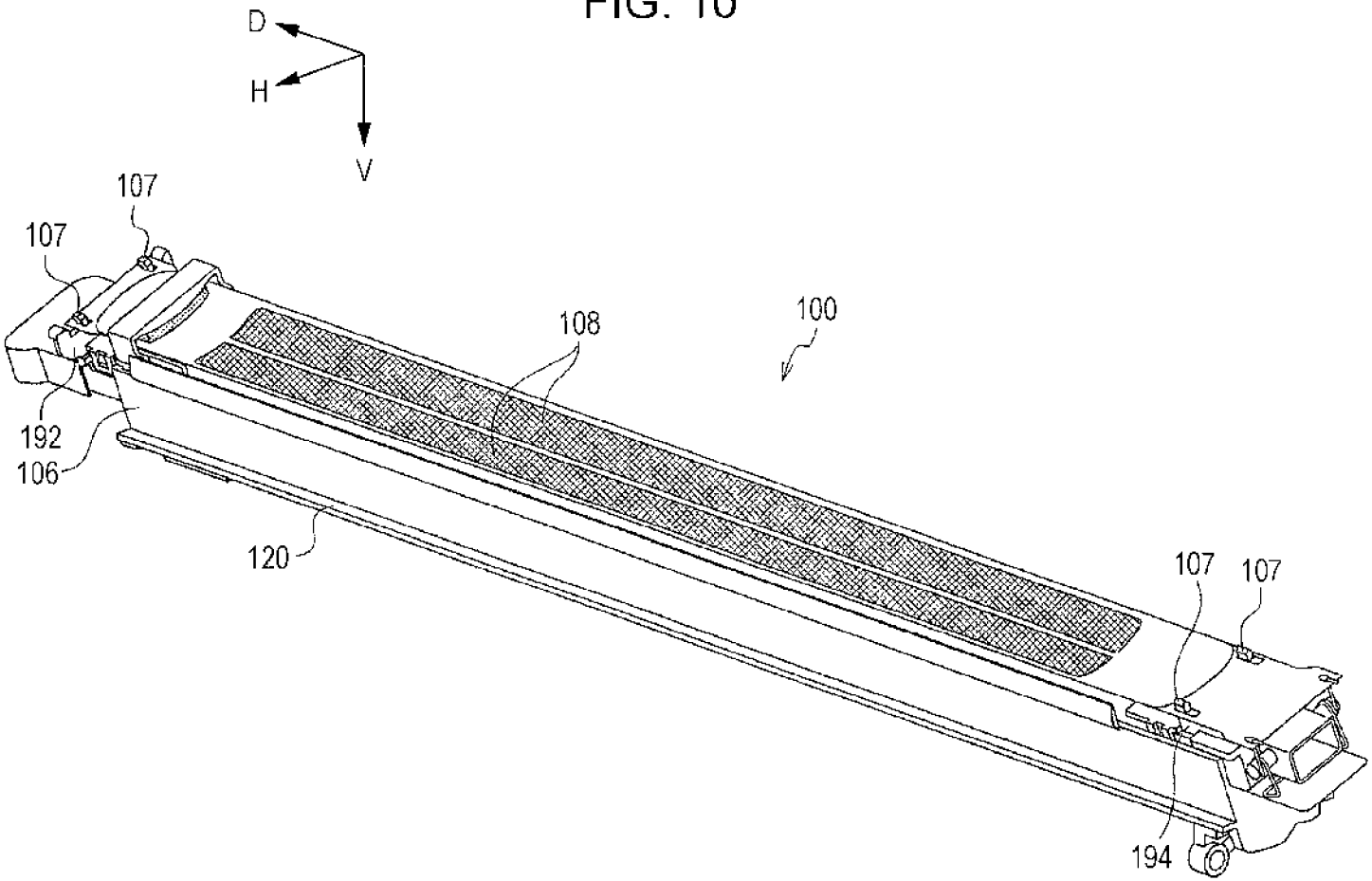
FIG. 10 is a perspective view of the charger included in the charging device according to the first exemplary embodiment of the present invention.
Figure 23:
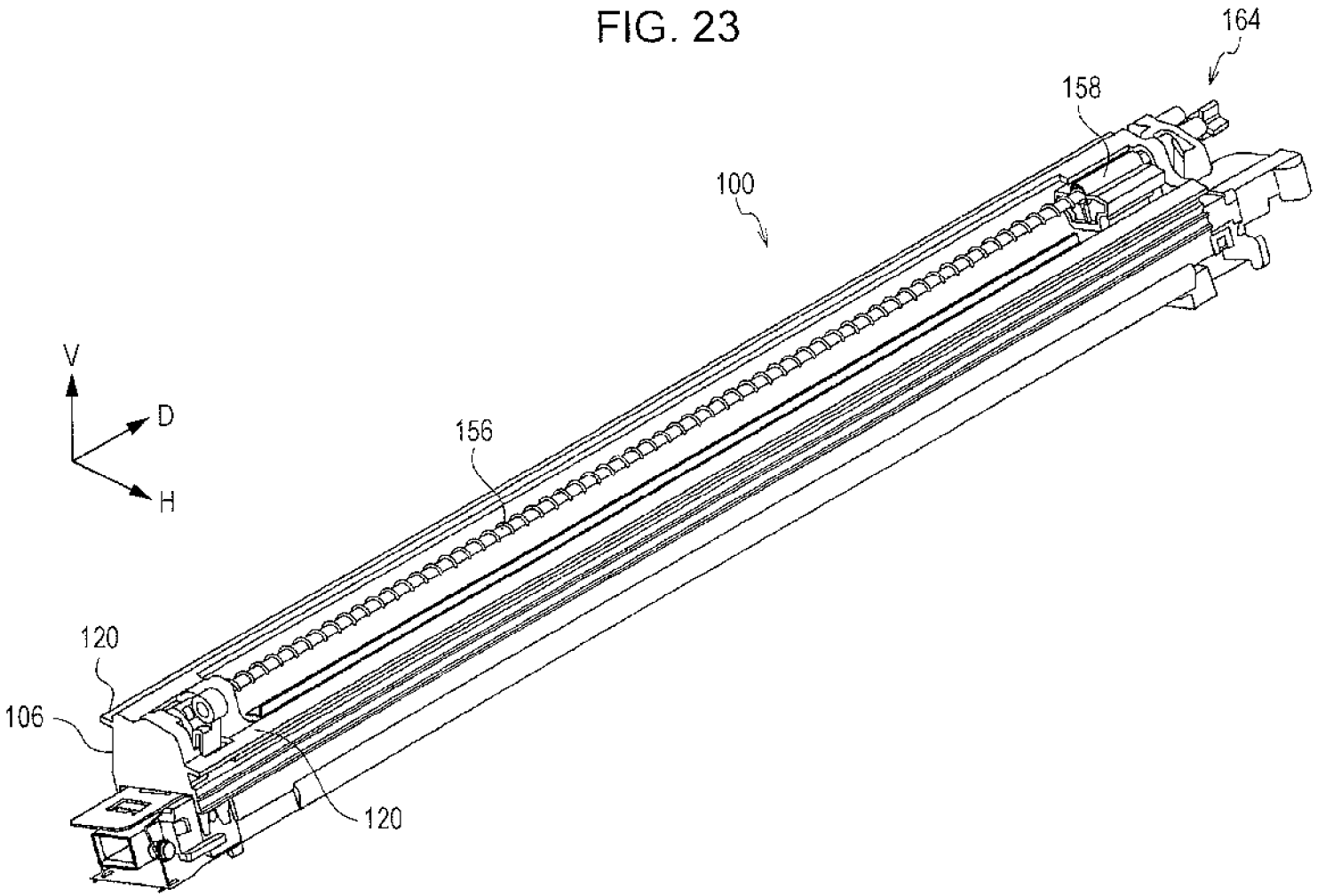
FIG. 23 is another perspective view of the charger included in the charging device according to the first exemplary embodiment of the present invention.

Referring to FIGS. 10 and 23, the charger 100 extends in the direction of the rotational axis and includes a housing 106 whose side facing the image carrier 62 (see FIG. 8) is open. The plate-like guide portions 120 project from the outer surface of the housing 106 and extend in the direction of the rotational axis.

Figure 9:
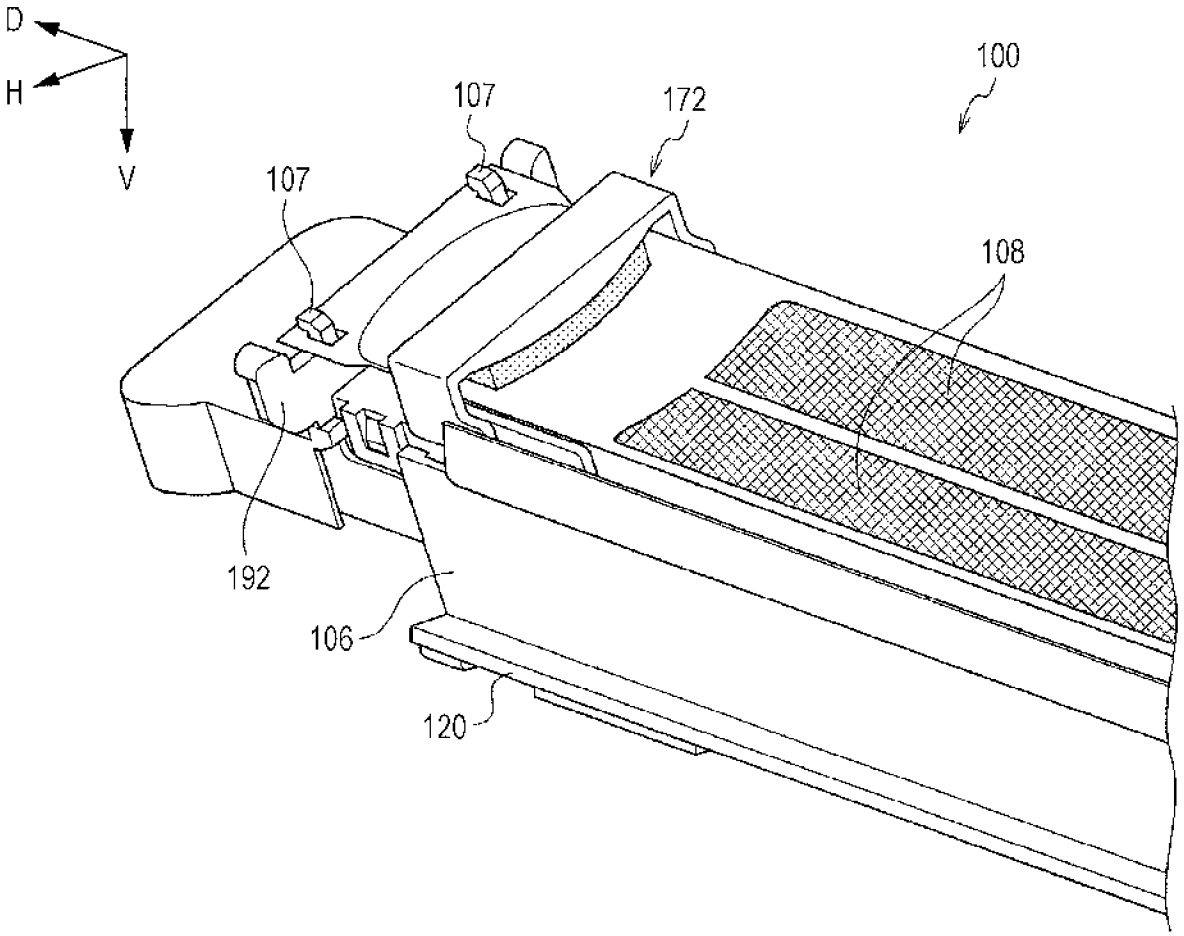
FIG. 9 is an enlarged perspective view of a charger included in the charging device according to the first exemplary embodiment of the present invention.

Referring to FIGS. 9 and 10, projections 107 are provided on wire supporting members 192 and 194, described separately below, near the corners of the open side of the housing 106 facing the image carrier 62. The projections 107 project toward the image carrier 62.

Figure 11:
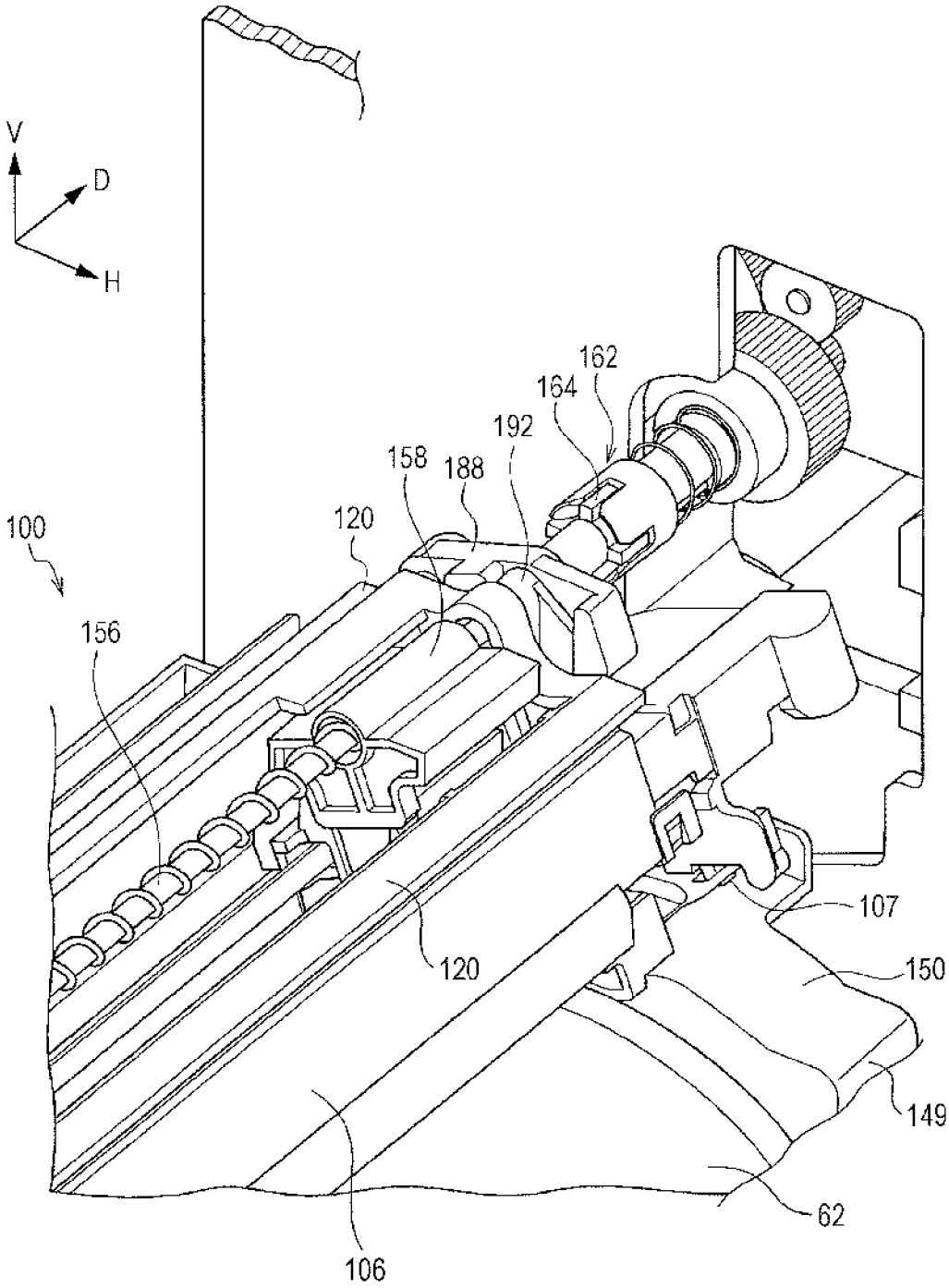
FIG. 11 is another enlarged perspective view of the charger included in the charging device according to the first exemplary embodiment of the present invention.

Referring to FIG. 11, the image carrier 62 is supported by support members 149 at two respective ends thereof in the direction of the rotational axis. The support members 149 supporting the image carrier 62 at the two respective ends in the direction of the rotational axis are secured to frame members (not illustrated).

The support members 149 have respective position reference portions 150. When the charger 100 is at the charging position, the projections 107 of the charger 100 are pressed against the position reference portions 150.

Specifically, referring to FIG. 8, when the charger 100 is at the charging position, the projections 107 are pressed against the position reference portions 150 of the support members 149 with the urging forces of the torsion springs 148. In this state, the bottom surfaces of the guide portions 120 are spaced apart from the respective rail portions 116.

That is, the shapes of the projections 107, the guide portions 120, and the rail portions 116 are determined such that the guide portions 120 are spaced apart from the respective rail portions 116 in the direction toward or away from the image carrier 62 in a state where the charger 100 is at the charging position and the projections 107 are pressed against the position reference portions 150 with the urging forces of the torsion springs 148.

Thus, the rail portions 116 do not prevent the projections 107 from being pressed against the position reference portions 150 with the urging forces of the torsion springs 148.

Referring to FIG. 8, the charger 100 includes the housing 106, two discharge wires 104 as exemplary discharge electrodes, and grids 108. The discharge wires 104 are provided inside the housing 106 and extend in the direction of the rotational axis. The grids 108 are meshed metal plates and cover the open side of the housing 106 facing the image carrier 62. The grids 108 are curved along the outer surface of the image carrier 62.

Figure 14:
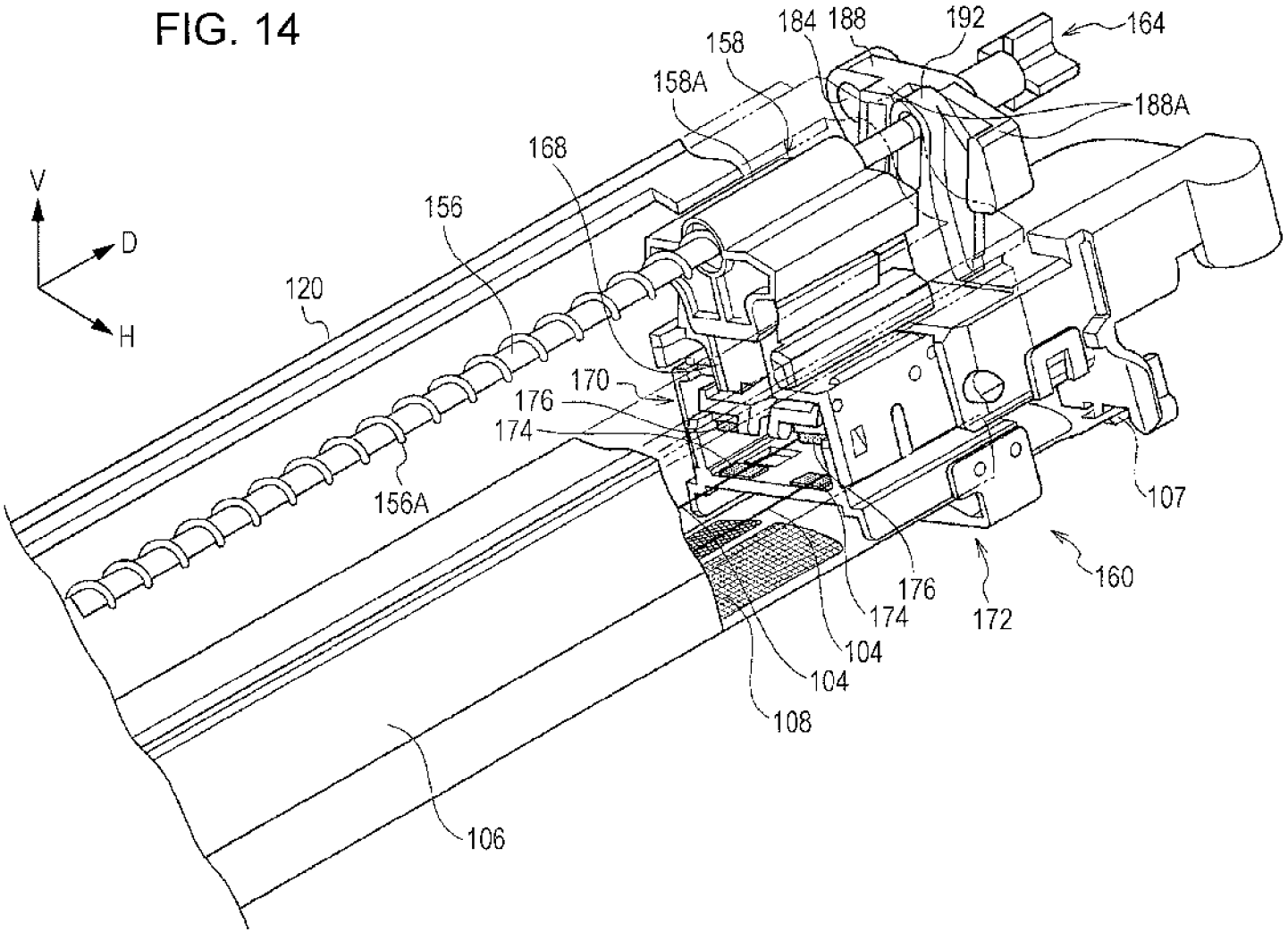
FIG. 14 is yet another enlarged perspective view of the charger included in the charging device according to the first exemplary embodiment of the present invention.

Referring to FIG. 14, the housing 106 houses a columnar lead shaft 156, a reciprocatable member 158, and a cleaning member 160. The lead shaft 156 is an exemplary columnar member extending in the direction of the rotational axis. When the lead shaft 156 receives a driving force transmitted thereto from a drive source (not illustrated) external to the charger 100, the lead shaft 156 rotates in the circumferential direction thereof. The rotational force of the lead shaft 156 is transmitted to the reciprocatable member 158 and causes the reciprocatable member 158 to move back and forth in the direction of the rotational axis. The cleaning member 160 is supported in such a manner as to be movable in the direction toward or away from the image carrier 62 relative to the reciprocatable member 158. The moving force of the reciprocatable member 158 acting in the direction of the rotational axis is transmitted to the cleaning member 160 and causes the cleaning member 160 to move in the direction of the rotational axis. Thus, the cleaning member 160 cleans the discharge wires 104 and the grids 108.

Figure 18:
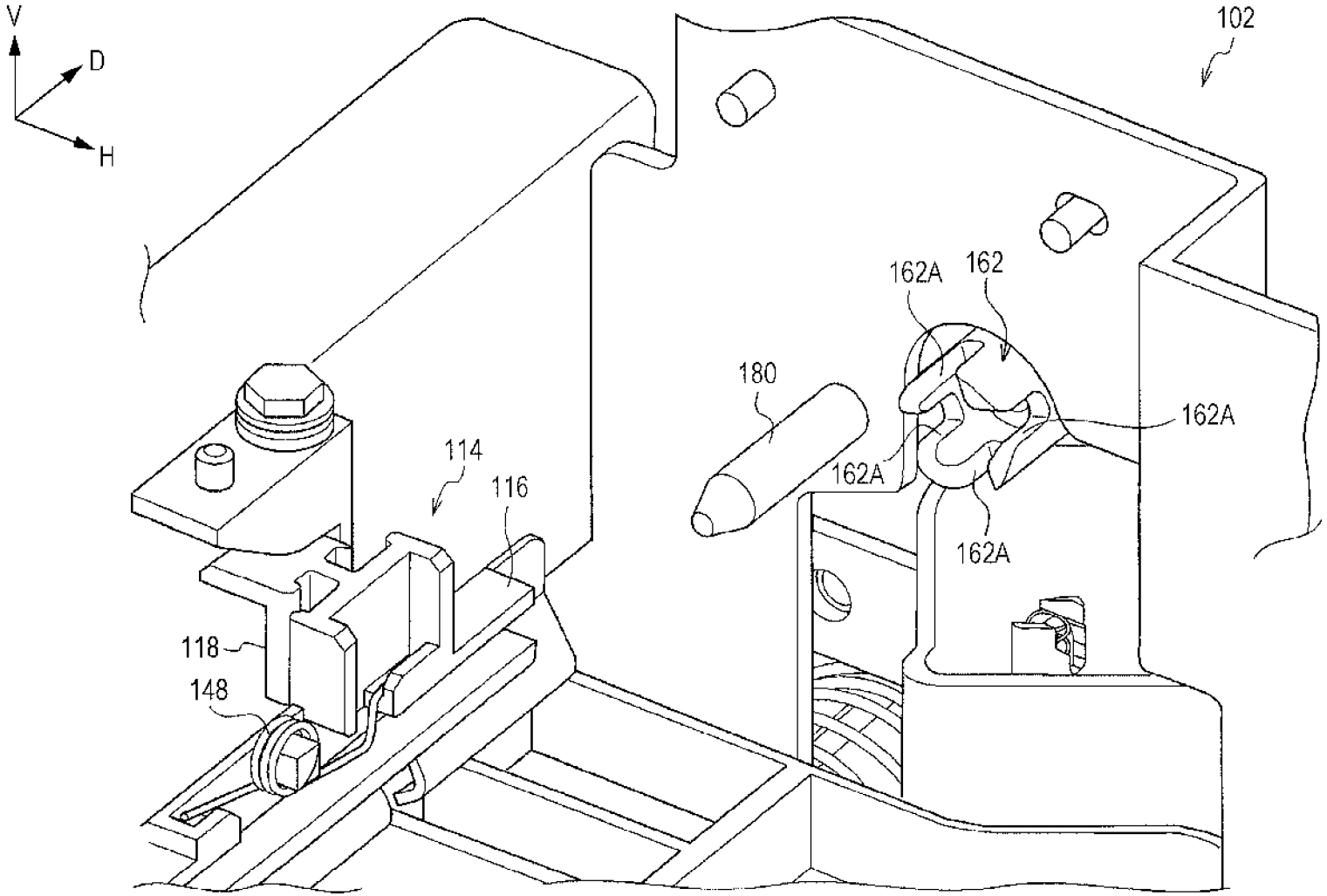
FIG. 18 is another enlarged perspective view of the device body included in the charging device according to the first exemplary embodiment of the present invention.
Figure 19:
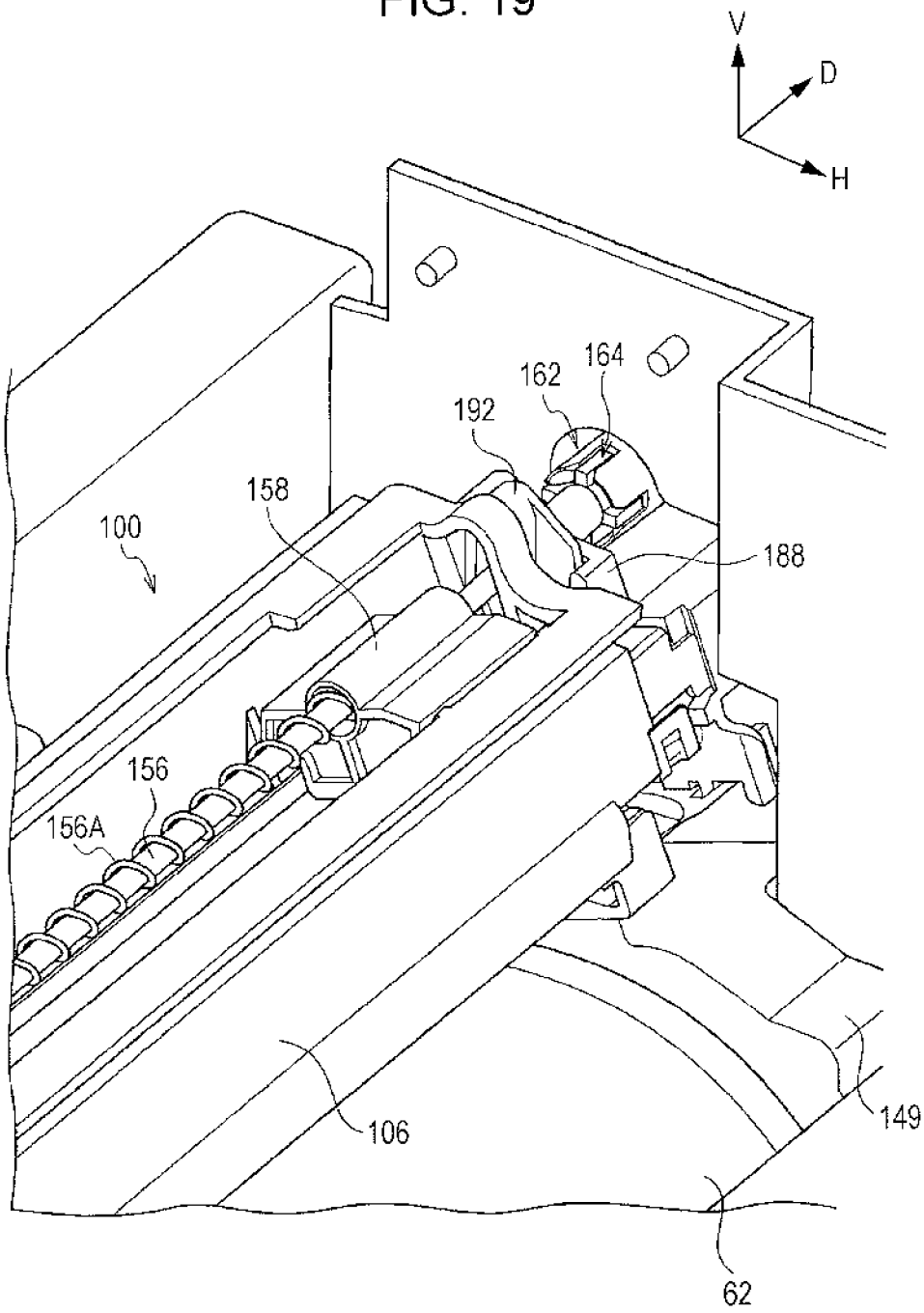
FIG. 19 is yet another enlarged perspective view of the charging device according to the first exemplary embodiment of the present invention.
Figure 20:
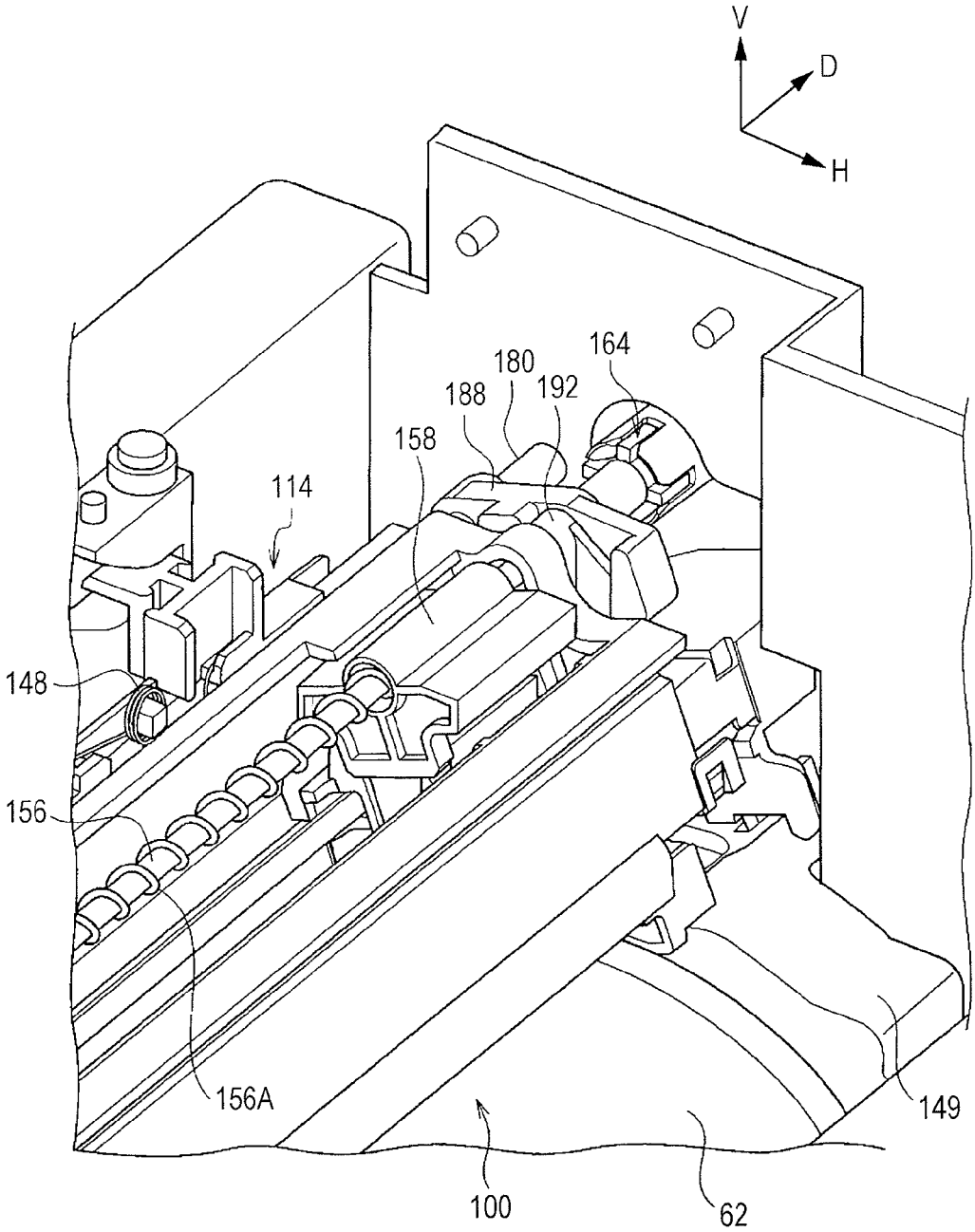
FIG. 20 is yet another enlarged perspective view of the charging device according to the first exemplary embodiment of the present invention.

Specifically, referring to FIG. 18, the device body 102 is provided with a recessed engaging portion 162 as an exemplary recessed portion. The recessed engaging portion 162 rotates when a driving force is transmitted thereto from a drive source (not illustrated) external to the charger 100. The recessed engaging portion 162 has in the wall thereof plural recesses 162A extending in the direction of the rotational axis. The lead shaft 156 has a transmission portion 164 (see FIG. 14) at one end thereof (the end on the rear side in the depth direction). The transmission portion 164 fits into the recesses 162A, whereby the driving force is transmitted to the transmission portion 164. Thus, as illustrated in FIGS. 19 and 20, the transmission portion 164 provided on the lead shaft 156 of the charger 100 that is attachable to and detachable from the device body 102 in the direction of the rotational axis is engageable with and disengageable from the recessed engaging portion 162 in the direction of the rotational axis.

Referring to FIG. 14, the lead shaft 156 that rotates in the circumferential direction thereof has a helical ridge 156A on the outer peripheral surface thereof. The reciprocatable member 158 includes a cylindrical portion 158A having a groove (not illustrated) in the inner peripheral surface thereof. The helical ridge 156A meshes with the groove. Thus, when the lead shaft 156 is rotated in one direction and the other direction, the reciprocatable member 158 moves back and forth in the direction of the rotational axis along the lead shaft 156.

The cleaning member 160 that cleans the discharge wires 104 and the grids 108 includes a connecting portion 168, a body portion 170, and a grid cleaning portion 172. The connecting portion 168 is supported in such a manner as to be movable in the direction toward or away from the image carrier 62 relative to the reciprocatable member 158. The moving force of the reciprocatable member 158 acting in the direction of the rotational axis is transmitted to the connecting portion 168. The body portion 170 is connected to an end of the connecting portion 168 and houses the discharge wires 104. The grid cleaning portion 172 is connected to the horizontal ends of the body portion 170 and cleans the grids 108 by coming into contact with the outer surfaces (the surfaces facing the image carrier 62) and the inner surfaces of the grids 108.

The connecting portion 168 is supported by the housing 106 in such a manner as to be movable in the direction toward or away from the image carrier 62 relative to the device body 102 with the movement of the housing 106 in the direction toward or away from the image carrier 62 and to be also movable in the direction of the rotational axis relative to the housing 106.

Figure 12:
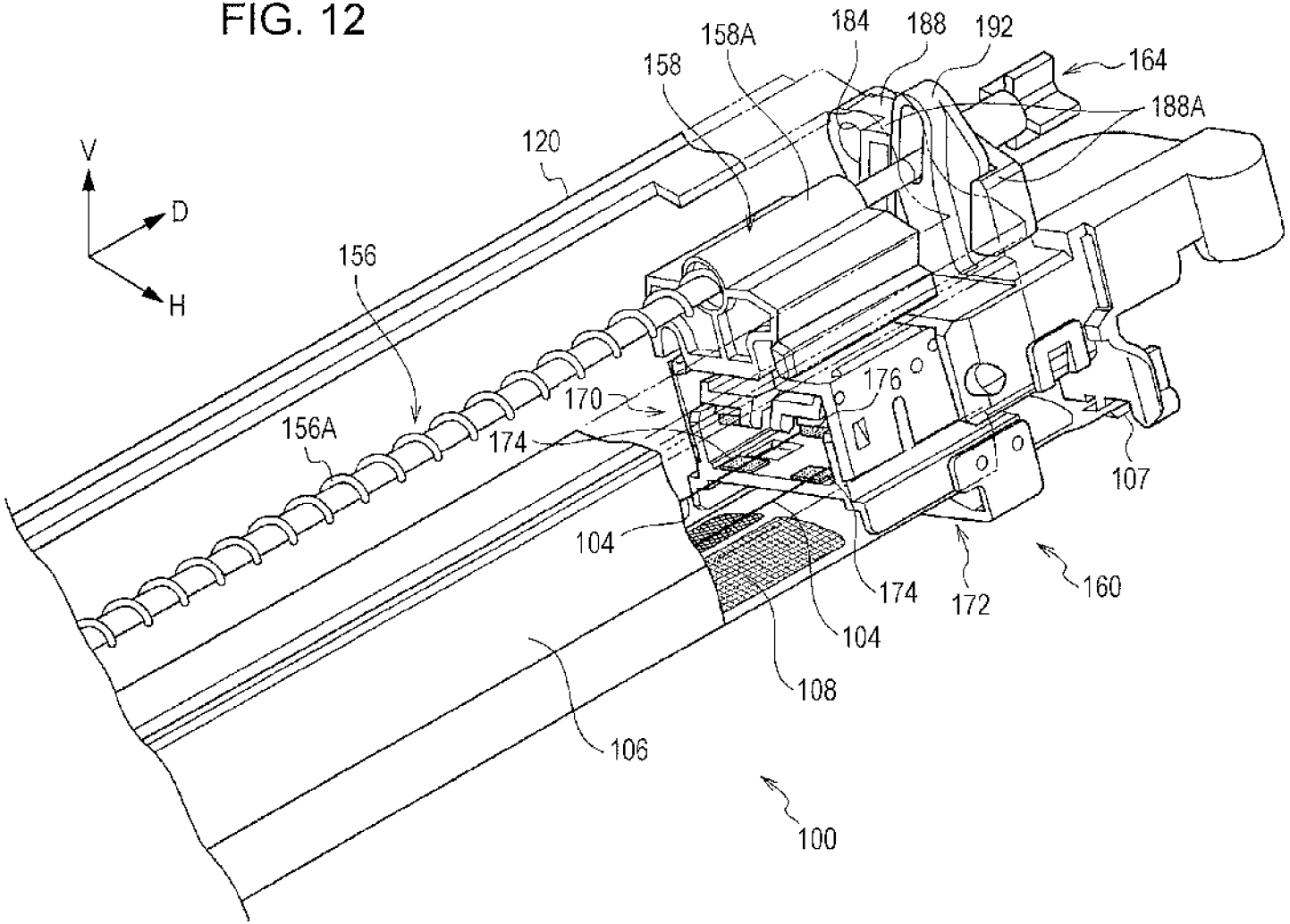
FIG. 12 is yet another enlarged perspective view of the charger included in the charging device according to the first exemplary embodiment of the present invention.
Figure 17:
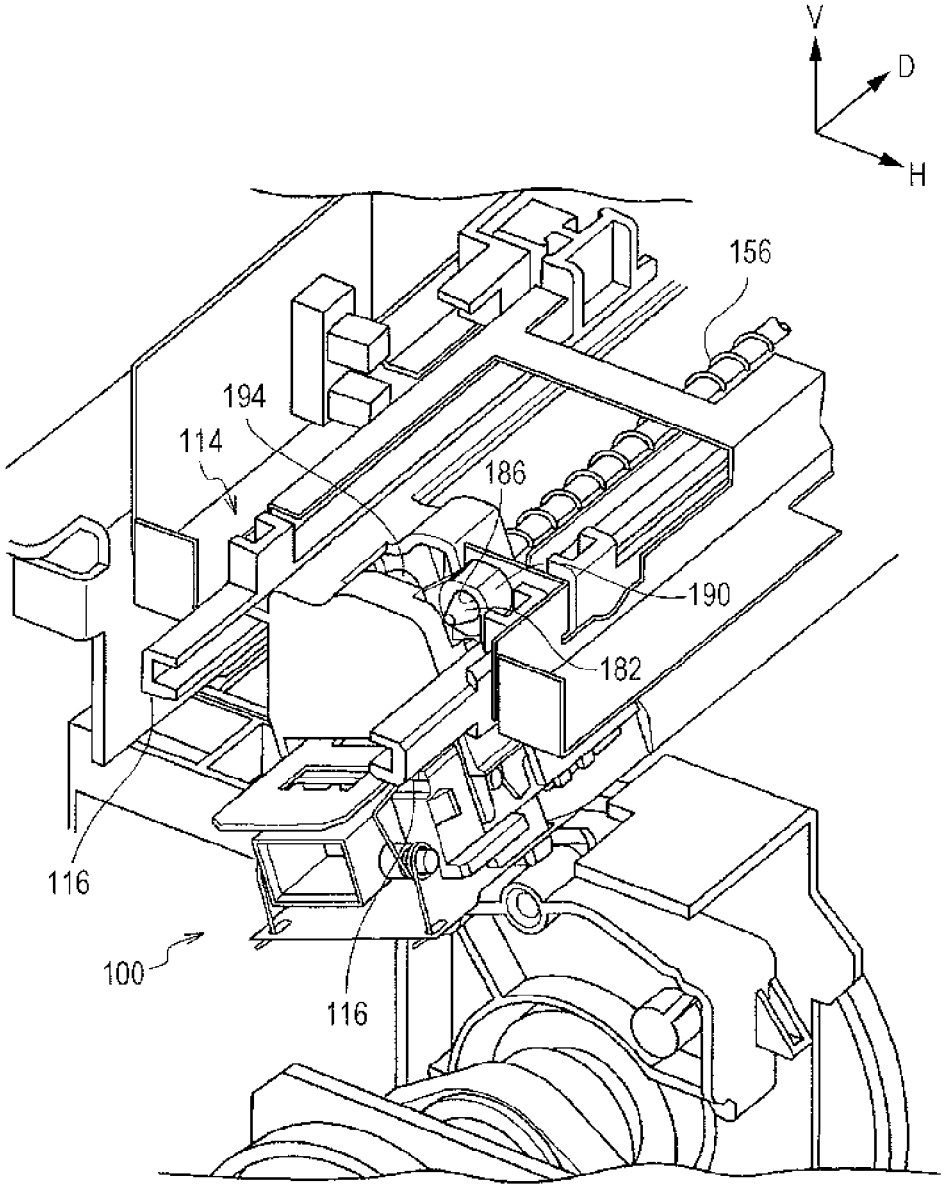
FIG. 17 is yet another enlarged perspective view of the charging device according to the first exemplary embodiment of the present invention.

Referring to FIGS. 12 and 17, the lead shaft 156 is rotatably supported at the two ends thereof by respective support members 188 and 190. The support members 188 and 190 support the respective wire supporting members 192 and 194 that support the ends of the discharge wires 104. The wire supporting members 192 and 194 are each held between guide portions 188A in such a manner to be movable in the direction toward or away from the image carrier 62. The wire supporting members 192 and 194 are secured to the housing 106 and are movable in the direction toward or away from the image carrier 62 with the movement of the housing 106 in the direction toward or away from the image carrier 62.

Thus, when the housing 106 moves in the direction toward or away from the image carrier 62, the wire supporting members 192 and 194, the discharge wires 104, and the cleaning member 160 move in the direction toward or away from the image carrier 62 relative to the device body 102, whereas the support members 188 and 190 and the lead shaft 156 are stationary.

Referring to FIGS. 12 and 14, the body portion 170 has thereinside cleaning pads 174 that are in contact with the discharge wires 104 from below and clean the discharge wires 104.

The body portion 170 also has thereinside cleaning pads 176. In a cleaning operation in which the cleaning member 160 moves in the direction of the rotational axis and cleans the discharge wires 104, the cleaning pads 176 come into contact with the respective discharge wires 104 from above, thereby cleaning the discharge wires 104.

Figure 15A:
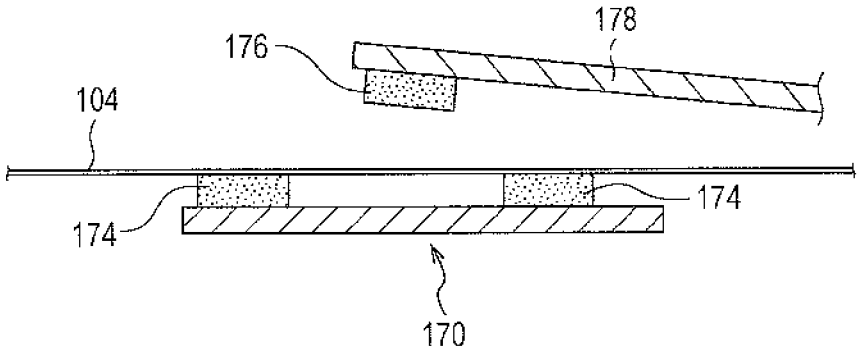
FIGS. 15A and 15B illustrate the configuration of a cleaning member provided to the charger included in the charging device according to the first exemplary embodiment of the present invention.
Figure 15B:
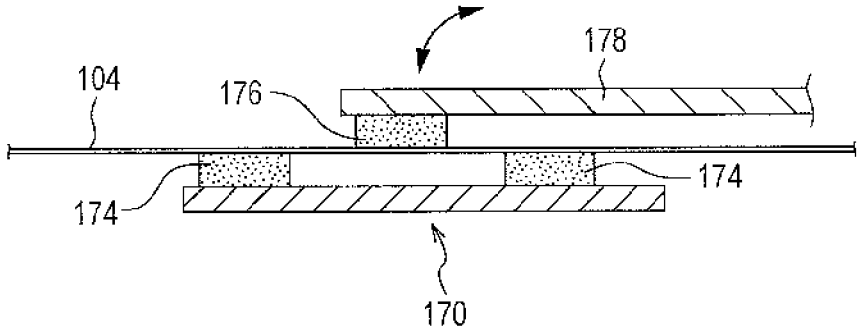

Specifically, referring to FIGS. 15A and 15B, the cleaning pads 176 are each attached to one end of a support member 178 extending in the direction of the rotational axis. The support member 178 rotates about the other end thereof. In a state illustrated in FIGS. 12 and 15A where the cleaning member 160 is standing by at the end of the charger 100, the cleaning pads 176 are held away from the discharge wires 104.

When the cleaning member 160 standing by at the end of the charger 100 that is at the retracted position is moved in the direction of the rotational axis to a cleaning start position (see FIG. 13), the support members 178 rotate as illustrated in FIG. 15B and the cleaning pads 176 come into contact with the top surfaces of the respective discharge wires 104.

When the cleaning member 160 in this state moves back and forth in the direction of the rotational axis along the discharge wires 104 and the grids 108, the discharge wires 104 and the grids 108 are cleaned. Specifically, when the charger 100 is at the retracted position, a gap that allows the grid cleaning portion 172 to pass therethrough is provided between the image carrier 62 and the grids 108. Thus, cleaning of the grids 108 is enabled.

Figure 16:
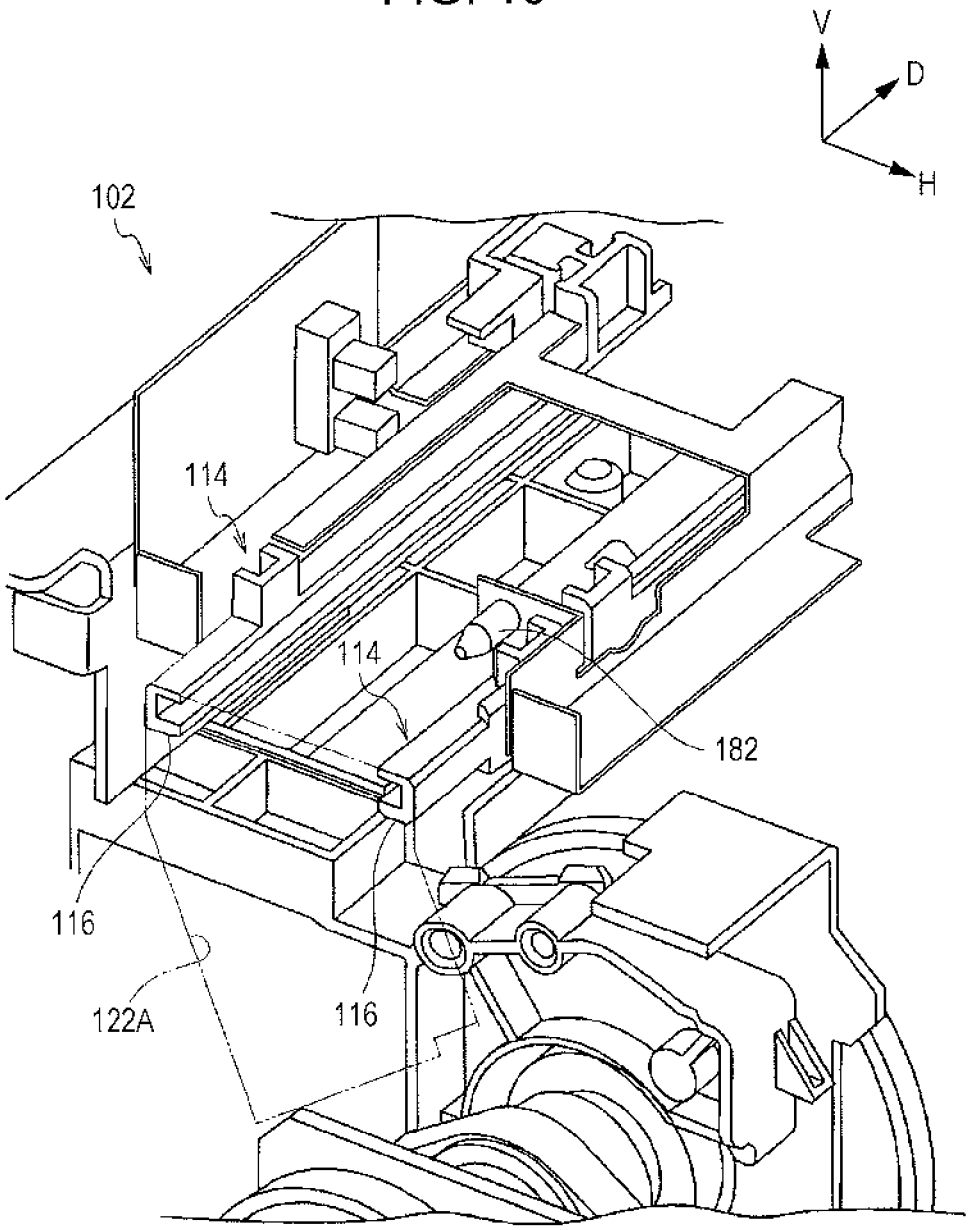
FIG. 16 is an enlarged perspective view of a device body included in the charging device according to the first exemplary embodiment of the present invention.

Referring to FIG. 18, the device body 102 is provided with a positioning pin 180 near the recessed engaging portion 162 (at a position facing an end of the charger 100 on one side in the direction of the rotational axis in a state where the charger 100 is set in the device body 102). The positioning pin 180 is an exemplary projecting member and projects in the direction of the rotational axis. Referring to FIG. 16, the device body 102 is provided with another positioning pin 182 near the opening 122A thereof (at a position facing an end of the charger 100 on the other side in the direction of the rotational axis in the state where the charger 100 is set in the device body 102). The positioning pin 182 is another exemplary projecting member and projects in the direction of the rotational axis.

Meanwhile, referring to FIG. 12, the support member 188 has a positioning hole 184 in which the positioning pin 180 (see FIG. 18) provided on the device body 102 is fitted in the state where the charger 100 is set in the device body 102. The positioning hole 184 is an exemplary fitting portion. Furthermore, referring to FIG. 17, the support member 190 has another positioning hole 186 in which the positioning pin 182 (see FIG. 16) provided on the device body 102 is fitted in the state where the charger 100 is set in the device body 102. The positioning hole 186 is another exemplary fitting portion.

In the above configuration, to attach the charger 100 to the device body 102, the guide portions 120 of the charger 100 are inserted into the respective rail portions 116 (see FIG. 7) provided on the device body 102, and the positioning holes 184 and 186 provided in the charger 100 are fitted onto the respective positioning pins 180 and 182 provided on the device body 102, whereby the transmission portion 164 provided at the end of the lead shaft 156 is fitted into the recesses 162A of the recessed engaging portion 162 (see FIG. 19).

Operation of Feature Configuration

The operation of the charging device 64 will now be described.

Figure 26:
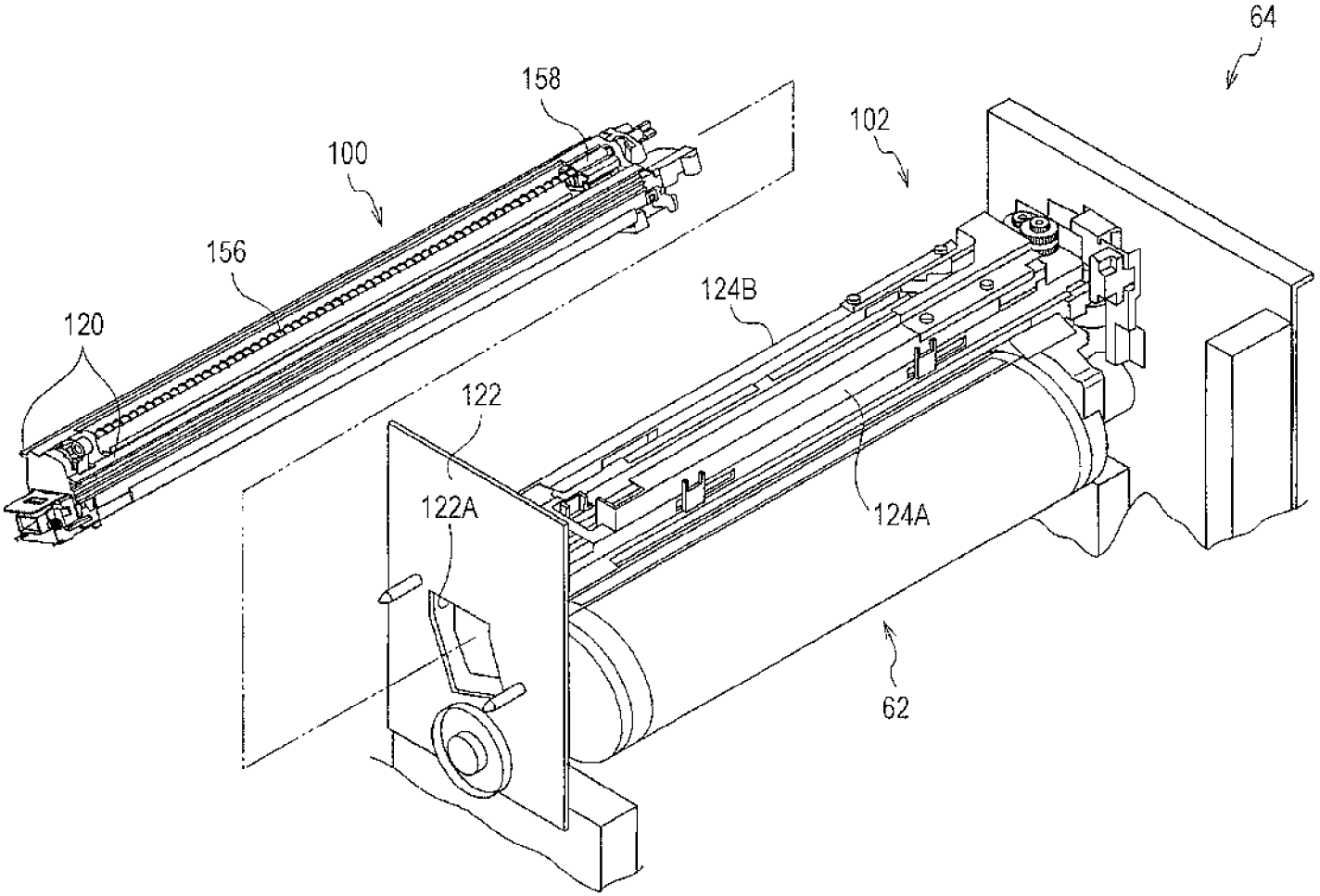
FIG. 26 is another perspective view of the charging device and the image carrier included in the image forming apparatus according to the first exemplary embodiment of the present invention.

Referring to FIG. 26, to detach the charger 100 from the device body 102, the charger 100 that has been moved from the charging position to the retracted position (see FIG. 7) is moved in the direction of the rotational axis. Thus, the charger 100 is detached from the device body 102.

Specifically, the charger 100 is drawn out in the direction of the rotational axis such that the guide portions 120 thereof slide along the respective rail portions 116 (see FIG. 7) provided on the device body 102. Thus, the charger 100 is detached from the device body 102.

To attach the charger 100 to the device body 102, the guide portions 120 of the charger 100 are inserted into the respective rail portions 116 (see FIG. 7) provided on the device body 102. Subsequently, referring to FIGS. 12 and 17, the positioning holes 184 and 186 provided in the charger 100 are fitted onto the respective positioning pins 180 (see FIG. 18) and 182 (see FIG. 16) provided on the device body 102. Thus, as illustrated in FIG. 19, the transmission portion 164 provided at the end of the lead shaft 156 is fitted into the recesses 162A of the recessed engaging portion 162, and the charger 100 is set at the retracted position (see FIG. 7).

Referring to FIG. 1, to move the charger 100 from the retracted position to the charging position, the stepping motor 130 is driven in accordance with an instruction from the controller 20 (see FIG. 29), and the driving force of the stepping motor 130 is transmitted to the movable member 124A having the rack 134 through the driving gear 132 and the train of gears 136.

Figure 7:
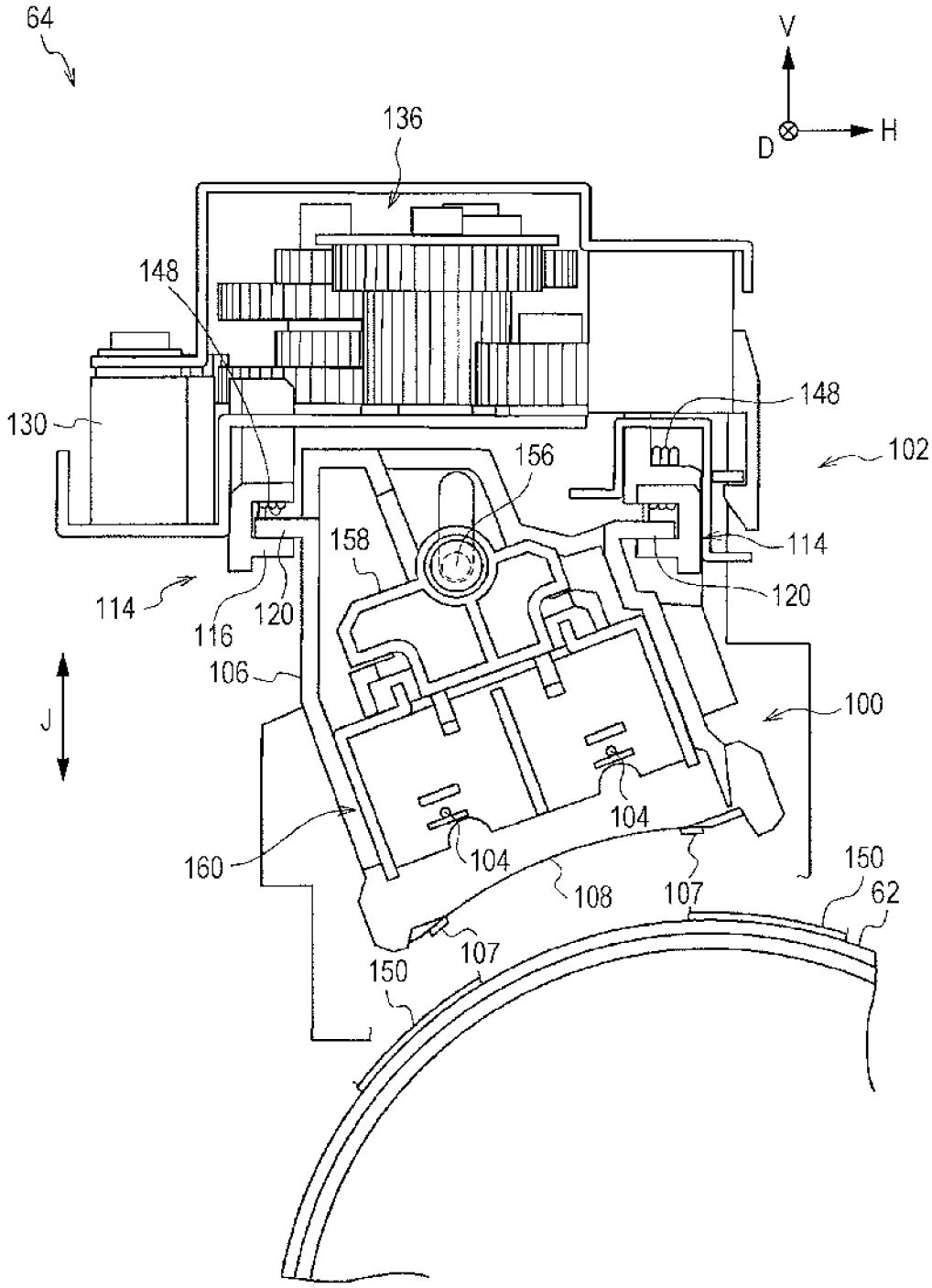
FIG. 7 is a sectional view of the charging device according to the first exemplary embodiment of the present invention.

Referring to FIGS. 1 to 4, the movable members 124 that have received the driving force from the stepping motor 130 move in the direction of the rotational axis (the direction of arrow K). When the movable members 124 move in the direction of the rotational axis (the direction of arrow K), the sloping portions 126 of the movable members 124 also move in the direction of the rotational axis (the direction of arrow K). With the movement of the sloping portions 126 in the direction of the rotational axis (the direction of arrow K), the contact portions 118A of the rail members 114 that are in contact with the respective sloping portions 126 slide along the sloping portions 126, whereby the rail members 114 move toward the image carrier 62 (see FIG. 7). When the charger 100 is at the retracted position as illustrated in FIG. 7, the bottom surfaces of the guide portions 120 of the charger 100 that are placed in the respective rail portions 116 are pressed against the rail portions 116 with the urging forces of the torsion springs 148.

When the rail members 114 move toward the image carrier 62 and the charger 100 is brought to the charging position as illustrated in FIG. 8, the driving of the stepping motor 130 is stopped in accordance with an instruction from the controller 20 (see FIG. 29). The driving of the stepping motor 130 is stopped as follows. When the movable member 124B moves in the direction of the rotational axis as illustrated in FIG. 4 such that the charger 100 is brought to the charging position, the detection plate 144 provided on the movable member 124B is inserted between the pair of detecting portions 142A of the sensor 142, whereby it is detected that the charger 100 has moved to the charging position. In response to this, the controller 20 issues an instruction to stop the driving of the stepping motor 130.

In addition, the connecting portion 168 of the cleaning member 160 is supported in such a manner as to be movable in the direction toward or away from the image carrier 62 relative to the reciprocatable member 158 supported by the lead shaft 156. Therefore, although the lead shaft 156 and the reciprocatable member 158 do not move in the direction toward or away from the image carrier 62, the other members of the charger 100 move in the direction toward or away from the image carrier 62.

Furthermore, when the charger 100 is brought to the charging position as illustrated in FIGS. 8 and 11, the projections 107 provided on the charger 100 are pressed against the position reference portions 150 provided on the image carrier 62 with the urging forces of the torsion springs 148. In a state where the projections 107 are pressed against the position reference portions 150, the bottom surfaces of the guide portions 120 are spaced apart from the respective rail portions 116.

Referring to FIGS. 2 and 4, to move the charger 100 from the charging position to the retracted position, the driving force of the stepping motor 130 that is driven in accordance with an instruction from the controller 20 (see FIG. 29) is transmitted to the movable members 124 through the driving gear 132 and the train of gears 136, whereby the movable members 124 move in the direction of the rotational axis (the direction of arrow L).

When the movable members 124 move in the direction of the rotational axis (the direction of arrow L) as illustrated in FIGS. 1 and 3, the sloping portions 126 of the movable members 124 also move in the direction of the rotational axis (the direction of arrow L). With the movement of the sloping portions 126 in the direction of the rotational axis (the direction of arrow L), the contact portions 118A of the rail members 114 that are in contact with the respective sloping portions 126 slide along the sloping portions 126 and thus move away from the image carrier 62 (see FIG. 7).

When the charger 100 moves away from the image carrier 62 as illustrated in FIG. 7, the projections provided on the charger 100 are moved away from the position reference portions 150 provided on the image carrier 62. Furthermore, the bottom surfaces of the guide portions 120 of the charger 100 placed in the respective rail portions 116 are pressed against the rail portions 116 with the urging forces of the torsion springs 148.

When the rail members 114 move away from the image carrier 62 and the charger 100 is brought to the retracted position, the driving of the stepping motor 130 is stopped in accordance with an instruction from the controller 20 (see FIG. 29). The driving of the stepping motor 130 is stopped as follows. When the movable member 124B moves in the direction of the rotational axis as illustrated in FIG. 3 such that the charger 100 is brought to the retracted position, the detection plate 144 provided on the movable member 124B is withdrawn from between the pair of detecting portions 142A of the sensor 142, whereby it is detected that the charger 100 has moved to the retracted position. In response to this, the controller 20 issues an instruction to stop the driving of the stepping motor 130.

Figure 13:
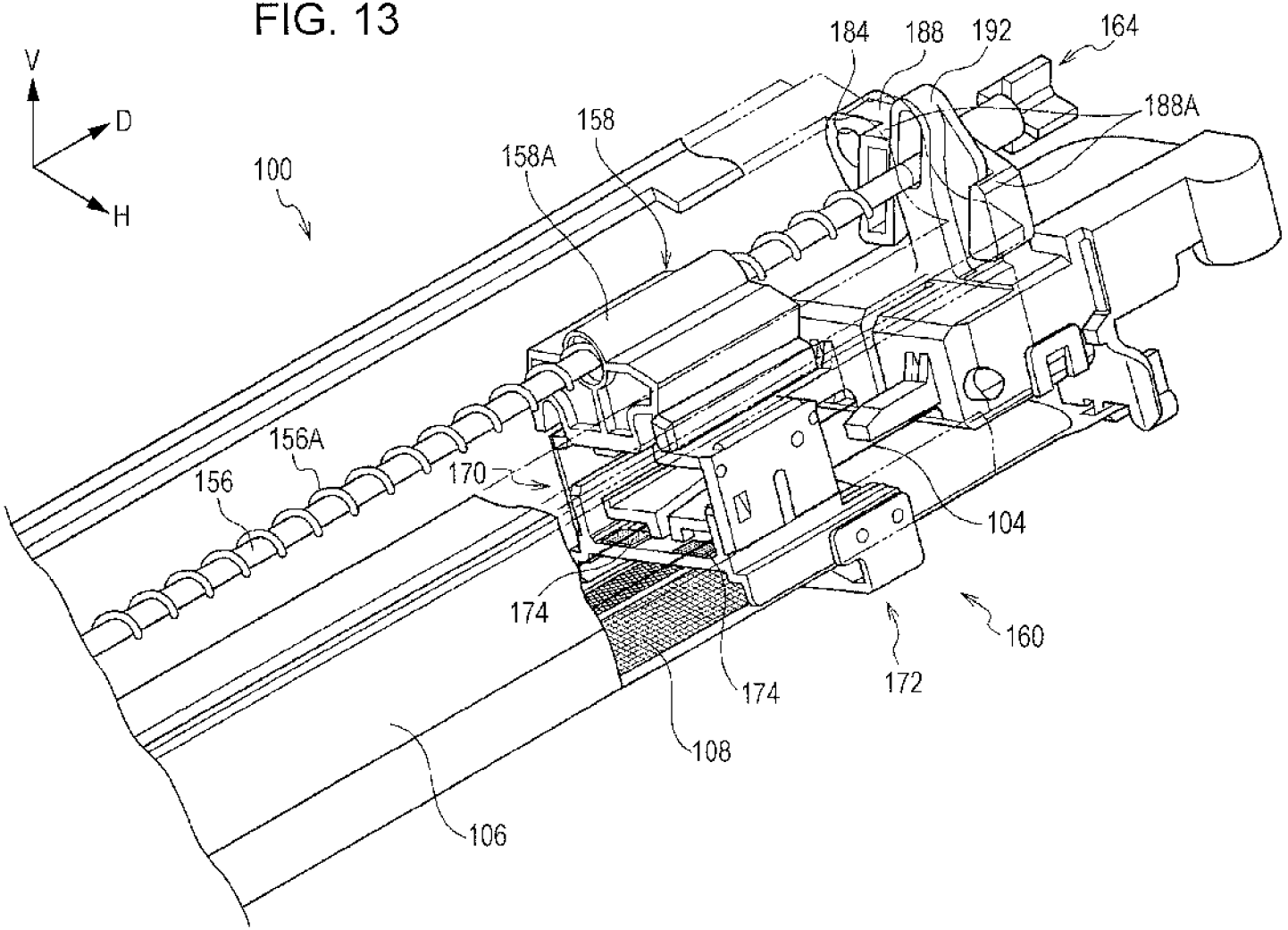
FIG. 13 is yet another enlarged perspective view of the charger included in the charging device according to the first exemplary embodiment of the present invention.

Referring to FIGS. 12 and 13, to clean the discharge wires 104 and the grids 108, the cleaning member 160 of the charger 100 that is at the retracted position is moved in the direction of the rotational axis.

Specifically, when the cleaning member 160 standing by at the end of the charger 100 is moved in the direction of the rotational axis to the cleaning start position (see FIG. 13), the support members 178 rotate as illustrated in FIGS. 15A and 15B and the cleaning pads 176 come into contact with the top surfaces of the respective discharge wires 104.

Furthermore, the grid cleaning portion 172 advances into the gap between the charger 100 and the image carrier 62 produced by the movement of the charger 100 to the retracted position, thereby coming into contact with the outer and inner surfaces of the grids 108.

In this state, the lead shaft 156 is rotated such that the cleaning member 160 moves back and forth in the direction of the rotational axis along the discharge wires 104 and the grids 108. Thus, the discharge wires 104 and the grids 108 are cleaned.

As described above, the moving force of the movable members 124 that move in the direction of the rotational axis is transmitted, by utilizing the sloping portions 126, to the charger 100 in the form of a moving force acting in the direction toward or away from the image carrier 62, whereby, at the retracted position, the charger 100 is attachable to and detachable from the device body 102. Thus, while the increase in the size of the charging device 64 in the direction toward or away from the image carrier 62 is suppressed, damaging of the surface of the image carrier 62 caused by the charger 100 that may come into contact with the image carrier 62 when the charger 100 is attached to or detached from the device body 102 is also suppressed.

Furthermore, by utilizing the sloping portions 126, the movement of the charger 100 in the direction toward or away from the image carrier 62 is realized with a simple configuration.

Furthermore, by providing the sensor 142 that detects the movement of the movable members 124, whether the charger 100 has moved to the charging position or to the retracted position is detected on the basis of the movement of the movable members 124.

Furthermore, by employing the charging device 64, the increase in the size of the image forming apparatus 10 is suppressed.

A charging device and an image forming apparatus according to a second exemplary embodiment of the present invention will now be described with reference to FIGS. 30A and 30B. Elements that are the same as those in the first exemplary embodiment are denoted by the same reference numerals as those in the first exemplary embodiment, and descriptions thereof are omitted.

Figure 30A:
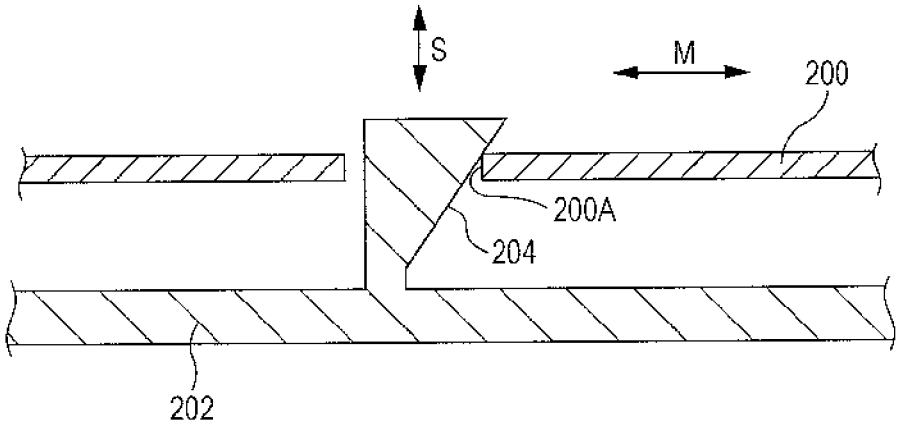
FIGS. 30A and 30B are diagrams of a movable member and a rail member included in a charging device according to a second exemplary embodiment of the present invention.
Figure 30B:
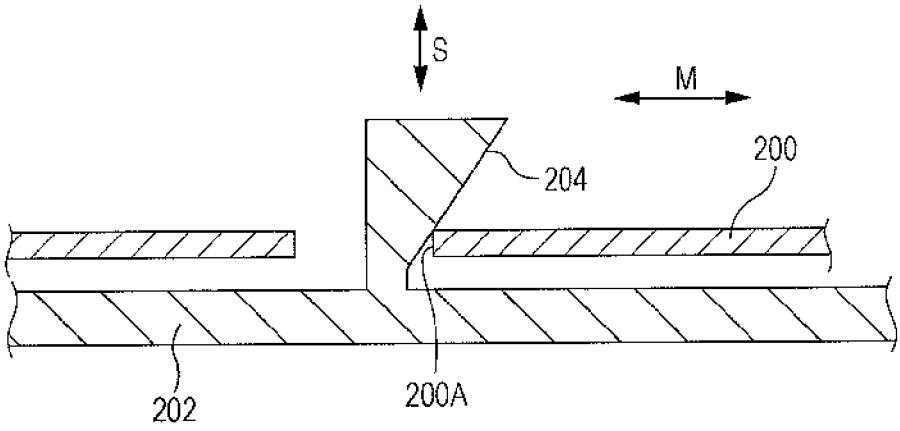

Referring to FIGS. 30A and 30B, each movable member 200 has no sloping portion. Instead, each rail member 202 has a sloping portion 204 sloping in the direction of the rotational axis.

Specifically, the movable member 200 is movable in the direction of the rotational axis (the direction of arrow M in FIGS. 30A and 30B) and has a sliding portion 200A that slides along the sloping portion 204. When the sliding portion 200A slides along the sloping portion 204, the rail member 202 is moved in the direction toward or away from the image carrier 62 (the direction of arrow S in FIGS. 30A and 30B).

While specific exemplary embodiments of the present invention have been described in detail, the present invention is not limited to such exemplary embodiments. It is obvious for those skilled in the art that various other exemplary embodiments are practicable within the scope of the invention. For example, although the first exemplary embodiment concerns a case where the movable members 124 are integrally provided with the sloping portions 126, the movable members may not necessarily be integrally provided with the sloping portions (the movable members may be provided separately from the sloping portions).

In addition, although the above exemplary embodiments concern a case where the grids 108 have curved shapes, flat grids or the like may alternatively be employed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications, as are suited to the particular use contemplated. It is intended that the scope of the invention be defined by the following claims and their equivalents.

What is claimed is:

1. A charging device comprising:

a charger facing a rotatably supported image carrier, the charger being configured to charge a surface of the image carrier on which an electrostatic latent image is to be formed; and a movement mechanism configured to move the charger between a charging position at which the charger is close to the surface of the image carrier and a retracted position at which the charger is retracted away from the surface of the image carrier, wherein the movement mechanism includes a support member supporting the charger that has been moved to the retracted position by the movement mechanism; and a movable member configured to move when a driving force from a drive source is transmitted thereto, and wherein the support member and the movable member are configured such that the movable member moves to the charging position or the retracted position when the movable member is moved in a direction of a rotational axis of the image carrier while being in contact with the support member.

2. The charging device according to claim 1, wherein the charger includes a discharge electrode extending in the direction of the rotational axis, the charger being configured to apply voltage to the discharge electrode.

3. The charging device according to claim 1, wherein the charger is supported in such a manner as to be attachable to and detachable from a body of the charging device in the direction of the rotational axis.

4. The charging device according to claim 1, wherein the movable member has a sloping portion that slopes away from the surface of the image carrier, and wherein the support member has a sliding portion that is in contact with the sloping portion, the sliding portion being configured to slide along the sloping portion and to move toward or away from the image carrier when the movable member is moved in the direction of the rotational axis.

5. The charging device according to claim 1, wherein the support member has a sloping portion that slopes away from the surface of the image carrier, and wherein the movable member has a sliding portion that is in contact with the sloping portion, the sliding portion being configured to slide along the sloping portion and to move the sloping portion in a direction toward or away from the image carrier when the movable member is moved in the direction of the rotational axis.

6. The charging device according to claim 1, wherein the movement mechanism further includes a pressing portion configured to press the charger toward the support member.

7. The charging device according to claim 1, further comprising a detector detecting that the charger has been brought close to the image carrier on the basis of the position of the movable member.

8. The charging device according to claim 4, further comprising a detector detecting that the charger has been brought close to the image carrier on the basis of the position of the movable member.

9. The charging device according to claim 5, further comprising a detector detecting that the charger has been brought close to the image carrier on the basis of the position of the movable member.

10. An image forming apparatus comprising:

a charging device according to claim 1; and an image carrier whose surface is to be charged by the charging device.

11. An image forming apparatus comprising:

a charging device according to claim 2; and an image carrier whose surface is to be charged by the charging device.

12. An image forming apparatus comprising:

a charging device according to claim 3; and an image carrier whose surface is to be charged by the charging device.

13. An image forming apparatus comprising:

a charging device according to claim 4; and an image carrier whose surface is to be charged by the charging device.

14. An image forming apparatus comprising:

a charging device according to claim 5; and an image carrier whose surface is to be charged by the charging device.

15. An image forming apparatus comprising:

a charging device according to claim 6; and an image carrier whose surface is to be charged by the charging device.

16. An image forming apparatus comprising:

a charging device according to claim 7; and an image carrier whose surface is to be charged by the charging device.

17. An image forming apparatus comprising:

a charging device according to claim 8; and an image carrier whose surface is to be charged by the charging device.

18. An image forming apparatus comprising:

a charging device according to claim 9; and an image carrier whose surface is to be charged by the charging device.

* * * * *